US011780225B2

(12) United States Patent
Katakura et al.

(10) Patent No.: US 11,780,225 B2
(45) Date of Patent: Oct. 10, 2023

(54) LIQUID DISCHARGING HEAD AND LIQUID DISCHARGING APPARATUS

(71) Applicant: Seiko Epson Corporation, Tokyo (JP)

(72) Inventors: Takahiro Katakura, Okaya (JP); Takanori Aimono, Matsumoto (JP); Shotaro Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/660,872

(22) Filed: Apr. 27, 2022

(65) Prior Publication Data

US 2022/0348014 A1 Nov. 3, 2022

(30) Foreign Application Priority Data

Apr. 30, 2021 (JP) ..... 2021-077278

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2002/14241; B41J 2002/14419; B41J 2002/14491; B41J 2202/11; B41J 2202/12; B41J 2/14233
See application file for complete search history.

(56) References Cited

U.S. PATENT DOCUMENTS

2020/0198349 A1* 6/2020 Uchida ..... B41J 2/14233

FOREIGN PATENT DOCUMENTS

JP 2021-024082 2/2021

* cited by examiner

*Primary Examiner* — Lisa Solomon
(74) *Attorney, Agent, or Firm* — WORKMAN NYDEGGER

(57) ABSTRACT

When a pressure of the liquid inside the common supply flow path is higher than a pressure of the liquid inside the pressure chamber, the adjustment portion changes the cross-sectional area to be a first cross-sectional area when a pressure difference, which is a difference between the pressure of the liquid inside the common supply flow path and the pressure of the liquid inside the pressure chamber, is a first pressure difference, and changes the cross-sectional area to be a second cross-sectional area larger than the first cross-sectional area when the pressure difference is a second pressure difference larger than the first pressure difference.

14 Claims, 25 Drawing Sheets

LIQUID DISCHARGING HEAD AND LIQUID DISCHARGING APPARATUS

The present application is based on, and claims priority from JP Application Serial Number 2021-077278, filed Apr. 30, 2021, the disclosure of which is hereby incorporated by reference herein in its entirety.

BACKGROUND

1. Technical Field

The present disclosure relates to a liquid discharging head and a liquid discharging apparatus.

2. Related Art

There is a liquid discharging head that discharges liquid such as ink. The liquid discharging head described in JP-A-2021-24082 includes a plurality of nozzles that discharge liquid, a plurality of individual flow paths provided for each of the plurality of nozzles, and a common liquid chamber that communicates in common with the plurality of individual flow paths.

In the liquid discharging head, the plurality of individual flow paths communicate with a common liquid chamber. The cross-sectional area of the individual flow path is narrower than the cross-sectional area of the common liquid chamber. Therefore, in a region where the cross-sectional area of the flow path is narrowed, particles present in the liquid may stay and the flow path may be clogged.

SUMMARY

According to one aspect of the present disclosure, there is provided a liquid discharging head that discharges liquid from a nozzle including a plurality of individual flow paths including a pressure chamber that communicates with the nozzle, a common supply flow path communicating in common with the plurality of individual flow paths and supplying the liquid to the plurality of individual flow paths, and an adjustment portion provided between the pressure chamber and the common supply flow path and changing a cross-sectional area of a flow path through which the liquid flows. When a pressure of the liquid inside the common supply flow path is higher than a pressure of the liquid inside the pressure chamber, the adjustment portion changes the cross-sectional area to be a first cross-sectional area when a pressure difference, which is a difference between the pressure of the liquid inside the common supply flow path and the pressure of the liquid inside the pressure chamber, is a first pressure difference, and changes the cross-sectional area to be a second cross-sectional area larger than the first cross-sectional area when the pressure difference is a second pressure difference larger than the first pressure difference.

According to another aspect of the present disclosure, there is provided a liquid discharging apparatus including the liquid discharging head described above and a discharge control portion controlling a discharging operation of discharging the liquid from the liquid discharging head.

DESCRIPTION OF EXEMPLARY EMBODIMENTS

Hereinafter, an embodiment of carrying out the present disclosure will be described with reference to the drawings.

However, in each drawing, the size and scale of each part are appropriately different from the actual ones. Further, the embodiments described below are suitable specific examples of the present disclosure, so various technically preferable limitations are attached, but the scope of the present disclosure is not limited to these embodiments unless otherwise stated to limit the present disclosure in the following description.

In the following description, the three directions intersecting each other may be described as the X axis direction, the Y axis direction, and the Z axis direction. The X axis direction includes the X1 direction and the X2 direction which are opposite directions to each other. The Y axis direction includes the Y1 direction and the Y2 direction which are opposite directions to each other. The Z axis direction includes the Z1 direction and the Z2 direction which are opposite directions to each other. The Z1 direction is a downward direction, and the Z2 direction is an upward direction. Further, in the present specification, the terms "top" and "bottom" are used. The "top" and "bottom" correspond to "top" and "bottom" in a normal use state in which a nozzle of a liquid discharging head 20 is positioned at the bottom.

The X axis direction, the Y axis direction, and the Z axis direction are orthogonal to each other. The Z axis direction is usually a direction along the vertical direction, but the Z axis direction does not have to be a direction along the vertical direction.

Figure 1:
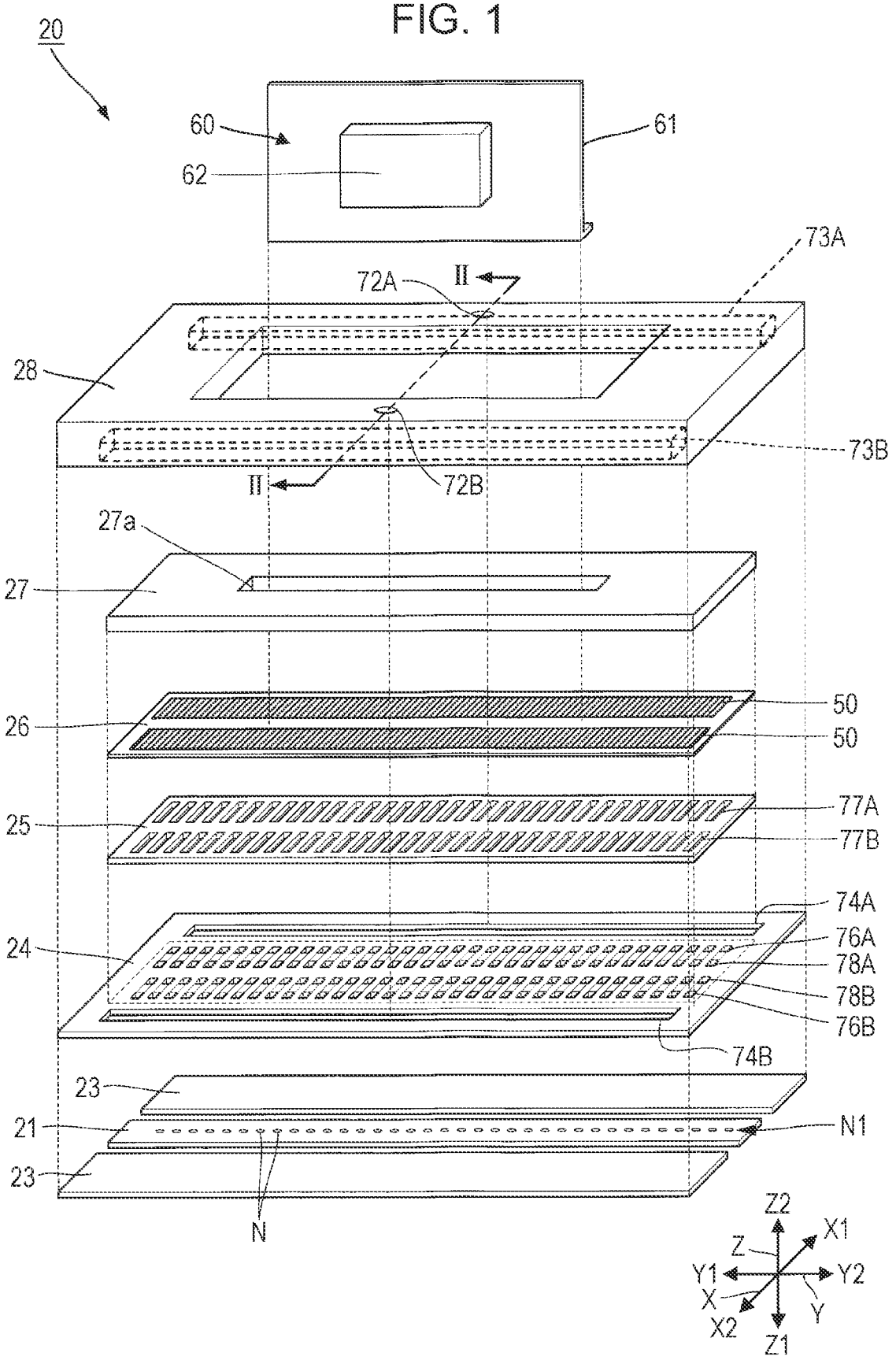
FIG. 1 is an exploded perspective view illustrating a liquid discharging head according to a first embodiment.
Figure 2:
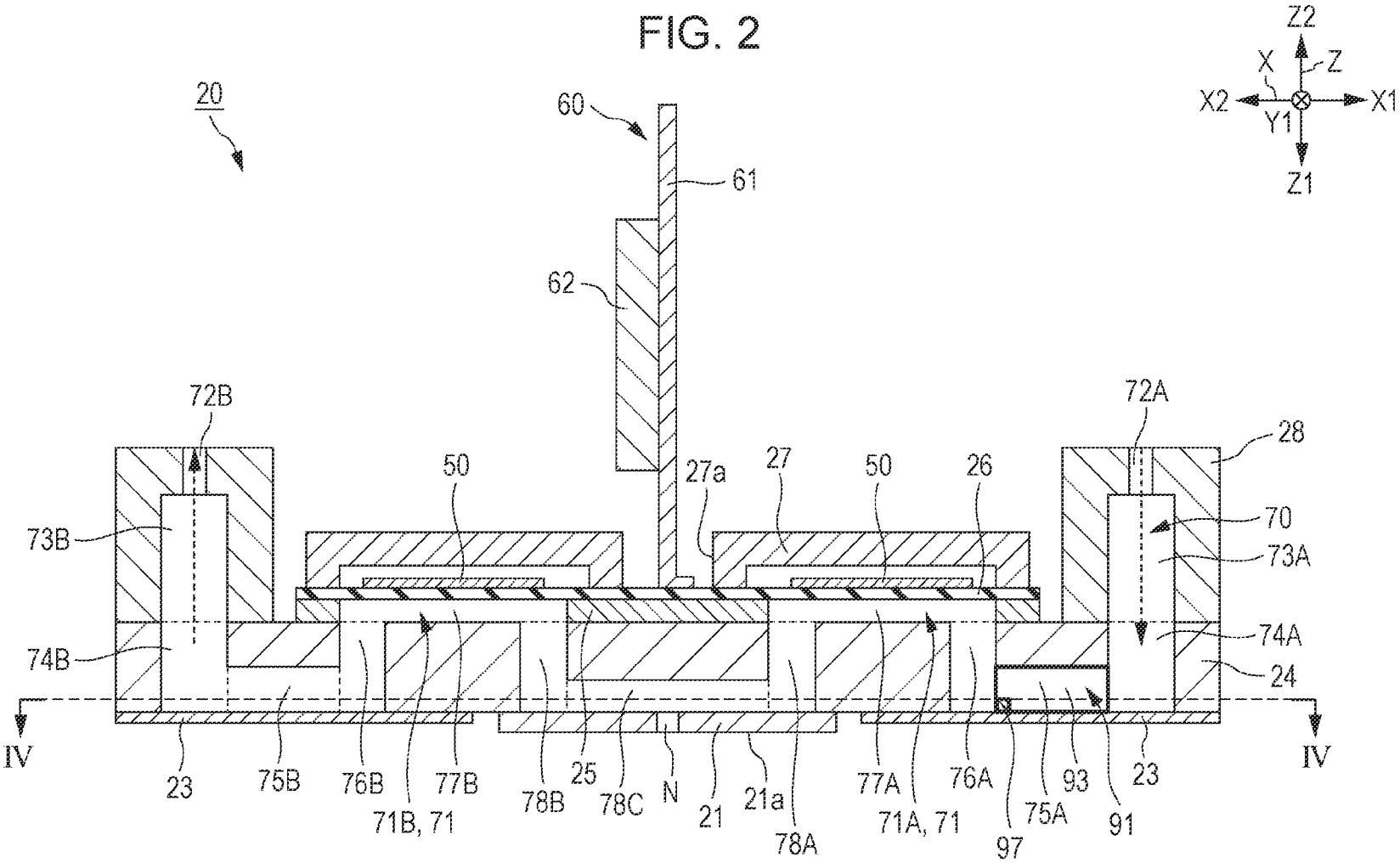
FIG. 2 is a cross-sectional view illustrating the liquid discharging head and is a view illustrating a cross section taken along the line II-II in FIG. 1.

FIG. 1 is a schematic view illustrating the liquid discharging head 20 according to a first embodiment. FIG. 2 is a cross-sectional view illustrating the liquid discharging head 20 and is a view illustrating a cross section taken along the line II-II in FIG. 1. The liquid discharging head 20 includes a nozzle plate 21, a compliance substrate 23, a communication plate 24, a pressure chamber formation plate 25, a vibrating plate 26, and a piezoelectric actuator 50. Further, the liquid discharging head 20 includes a protective substrate 27, a case 28, and a COF 60. The COF is an abbreviation for Chip on Film. The communication plate 24 is an example of a flow path substrate.

The thickness directions of the nozzle plate 21, the compliance substrate 23, the communication plate 24, the pressure chamber formation plate 25, the vibrating plate 26, the protective substrate 27, and the case 28 are along the Z axis direction. The nozzle plate 21 and the compliance substrate 23 are disposed at a bottom portion of the liquid discharging head 20. The communication plate 24 is disposed in the Z2 direction of the nozzle plate 21 and the compliance substrate 23. The pressure chamber formation plate 25 is disposed in the Z2 direction of the communication plate 24. The vibrating plate 26 is disposed in the Z2 direction of the pressure chamber formation plate 25. A plurality of piezoelectric actuators 50 are formed on the vibrating plate 26. The protective substrate 27 is disposed in the Z2 direction of the vibrating plate 26. The protective substrate 27 covers the plurality of piezoelectric actuators 50. The case 28 is disposed on the communication plate 24.

As illustrated in FIG. 2, the liquid discharging head 20 is formed with a flow path 70 through which the ink flows. The flow path 70 includes a supply port 72A, an exhaust port 72B, common liquid chambers 73A, 73B, 74A, and 74B, relay flow paths 75A, 75B, 76A, and 76B, pressure chambers 77A and 77B, communication flow paths 78A, 78B, and 78C, and a nozzle N. The flow path 70 includes a plurality of individual flow paths 71. The individual flow path 71 has an individual flow path 71A on a supply side and an individual flow path 71B on an exhaust side. The individual flow path 71A on the supply side may include the relay flow paths 75A and 76A, the pressure chamber 77A, the communication flow path 78A, and a part of the communication flow path 78C. The individual flow path 71B on the exhaust side may include a part of the communication flow path 78C, the communication flow path 78B, the pressure chamber 77B, and the relay flow paths 75B and 76B. The common liquid chambers 73A and 74A are examples of a common supply flow path that communicates in common with the plurality of individual flow paths 71 and supplies the liquid to the plurality of individual flow paths 71. The common liquid chambers 73B and 74B are examples of a common exhaust flow path that communicates in common with the plurality of individual flow paths 71 and exhausts the liquid flowing in from the plurality of individual flow paths 71.

The ink passes through the supply port 72A and flows into the common liquid chamber 73A. The common liquid chambers 73A and 74A form a common liquid chamber that communicates with each other. The ink inside the common liquid chambers 73A and 74A passes through the relay flow path 75A and is supplied to the pressure chamber 77A. The ink inside the pressure chamber 77A passes through the communication flow paths 78A and 78C and is discharged from the nozzle N.

Of the ink inside the communication flow path 78C, the ink that is not discharged from the nozzle N passes through the communication flow path 78B and flows into the pressure chamber 77B. The ink inside the pressure chamber 77B passes through the relay flow path 75B and is exhausted to the common liquid chamber 74B. The common liquid chambers 73B and 74B form a common liquid chamber that communicates with each other. The ink inside the common liquid chamber 73B passes through the exhaust port 72B and is exhausted to the outside of the liquid discharging head 20. The flow of the ink outside the liquid discharging head 20 will be described later.

Figure 3:
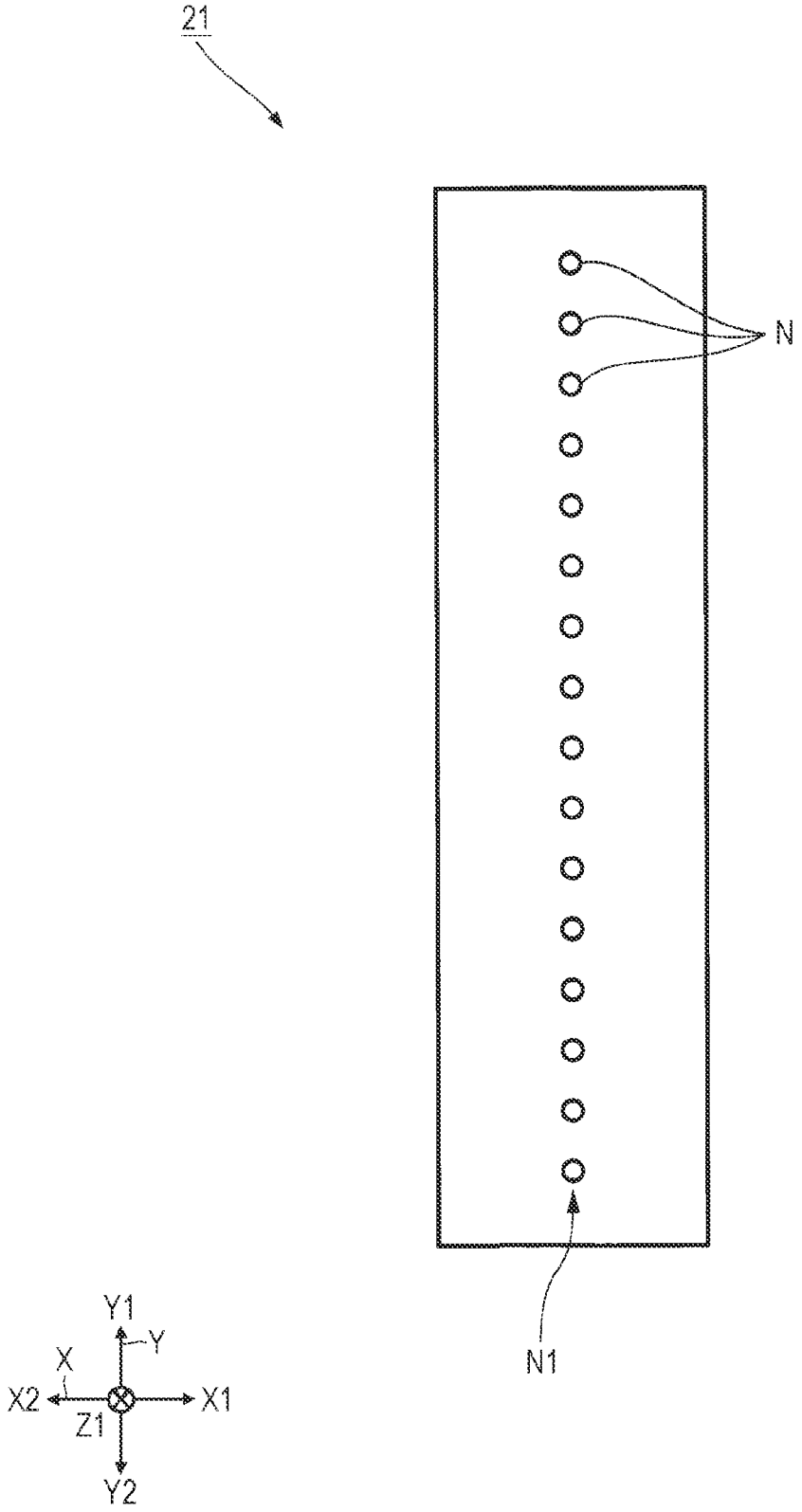
FIG. 3 is a plan view illustrating a nozzle plate.

FIG. 3 is a plan view illustrating the nozzle plate 21. The nozzle plate 21 has a rectangular shape when viewed in the Z axis direction. A plurality of nozzles N are formed on the nozzle plate 21. The plurality of nozzles N are arranged in the Y axis direction to form a nozzle row N1. The nozzle N is a through hole that penetrates the nozzle plate 21 in the Z axis direction.

As illustrated in FIGS. 1 and 2, a compliance substrate 23 is disposed on both sides of the nozzle plate 21 in the X axis direction. The compliance substrate 23 includes a film having flexibility. The compliance substrate 23 forms the bottom surface of the common liquid chambers 74A and 74B. The compliance substrate 23 is deformable under the pressure of the ink. The compliance substrate 23 is deformed by the pressure of the ink and can absorb the pressure fluctuation of the ink inside the liquid discharging head 20.

Figure 4:
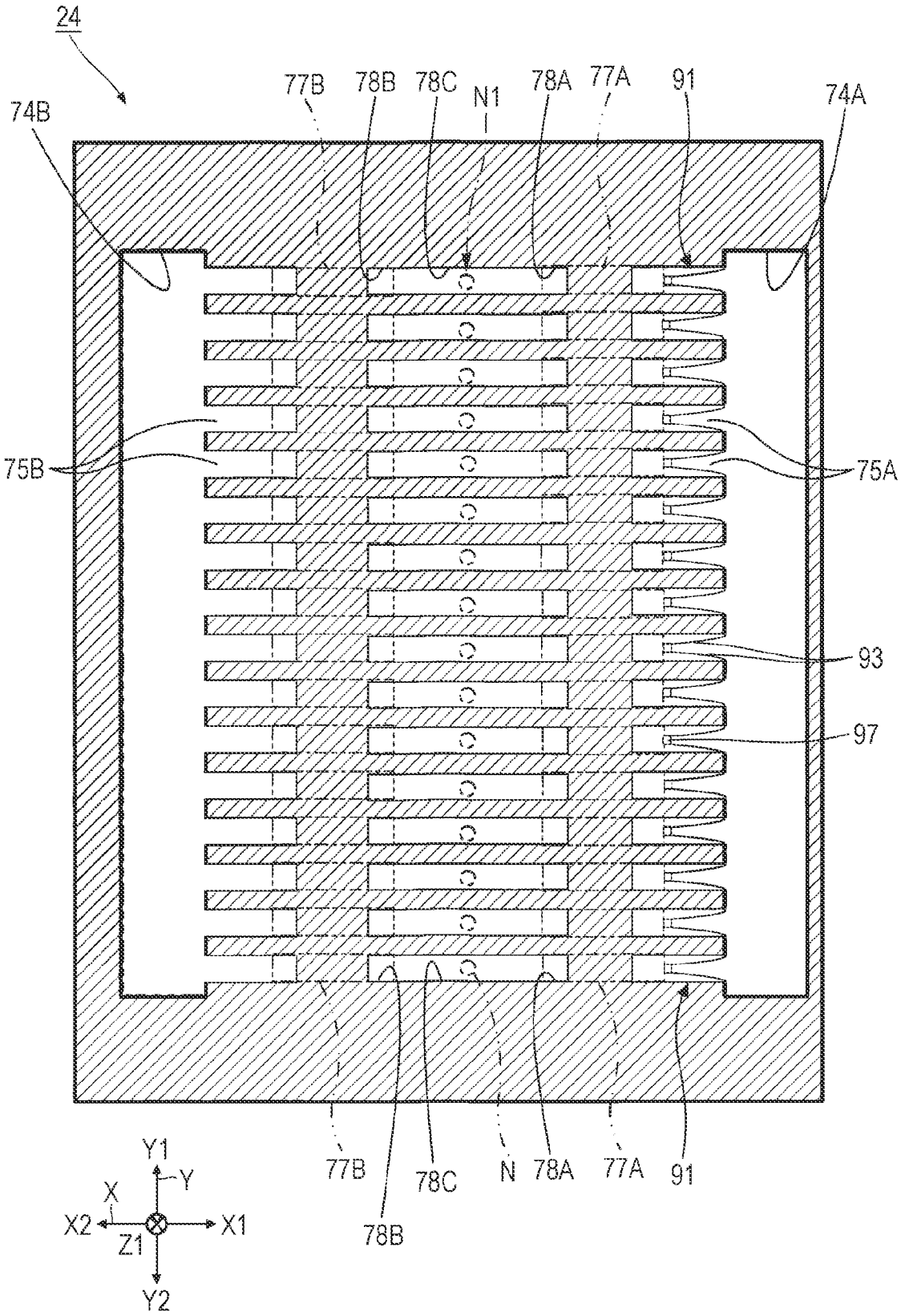
FIG. 4 is a cross-sectional view illustrating a communication plate and is a view illustrating a cross section taken along the line IV-IV in FIG. 2.

FIG. 4 is a cross-sectional view illustrating the communication plate 24. As illustrated in FIGS. 2 and 4, the communication plate 24 is formed with common liquid chambers 74A and 74B, relay flow paths 75A and 75B, and communication flow paths 78A, 78B, and 78C. In FIG. 4, positions of the pressure chambers 77A and 77B, and the nozzle N are illustrated with virtual lines.

The common liquid chambers 74A and 74B are long in the Y axis direction. The lengths of the common liquid chambers 74A and 74B in the Y axis direction correspond to the arrangement of the plurality of nozzles N. The common liquid chamber 74A is disposed so as to overlap the common liquid chamber 73A when viewed in the Z axis direction. The common liquid chamber 74A penetrates in the Z axis direction. The common liquid chamber 74B is disposed so as to overlap the common liquid chamber 73B when viewed in the Z axis direction. The common liquid chamber 74B penetrates in the Z axis direction. A part of the common liquid chamber 74B closer to the nozzle N is formed up to a position overlapping the pressure chamber 77B when viewed in the Z axis direction.

The relay flow paths 75A and 76A make the pressure chamber 77A and the common liquid chamber 74A communicate with each other. The relay flow paths 75A and 76A are provided for each of the plurality of pressure chambers 77A. The plurality of relay flow paths 75A and 76A are arranged at predetermined intervals in the Y axis direction. The relay flow path 75A extends in the X axis direction. The relay flow path 76A extends in the Z axis direction. An end portion of the relay flow path 75A in the X1 direction communicates with the common liquid chamber 74A. An end portion of the relay flow path 75A in the X2 direction communicates with an end portion of the relay flow path 76A in the Z1 direction. An end portion of the relay flow path 76A in the Z2 direction communicates with the pressure chamber 77A.

The relay flow paths 75B and 76B make the pressure chamber 77B and the common liquid chamber 74B communicate with each other. The relay flow paths 75B and 76B are provided for each of the plurality of pressure chambers 77B. The plurality of relay flow paths 75B and 76B are arranged at predetermined intervals in the Y axis direction. The relay flow path 75A extends in the X axis direction. The relay flow path 76B extends in the Z axis direction. An end portion of the relay flow path 75B in the X2 direction communicates with the common liquid chamber 74A. An end portion of the relay flow path 75B in the X2 direction communicates with an end portion of the relay flow path 76B in the Z1 direction. An end portion of the relay flow path 76B in the Z2 direction communicates with the pressure chamber 77B.

The communication flow paths 78A, 78B, and 78C extend in the X axis direction and makes the pressure chamber 77A and the pressure chamber 77B communicate with each other. The communication flow paths 78A, 78B, and 78C are provided for each of the plurality of pressure chambers 77A and 77B. The plurality of communication flow paths 78A, 78B, and 78C are disposed at predetermined intervals in the Y axis direction.

The communication flow paths 78A and 78B penetrate the communication plate 24 in the Z axis direction. The communication flow paths 78A and 78B are separated from each other in the X axis direction. The communication flow path 78A is disposed at a position overlapping the pressure chamber 77A when viewed in the Z axis direction. The communication flow path 78B is disposed at a position overlapping the pressure chamber 77B when viewed in the Z axis direction. The communication flow path 78C extends in the X axis direction and makes the communication flow path 78A and the communication flow path 78B communicate with each other. The nozzle N communicates with each of the plurality of communication flow paths 78C.

Figure 5:
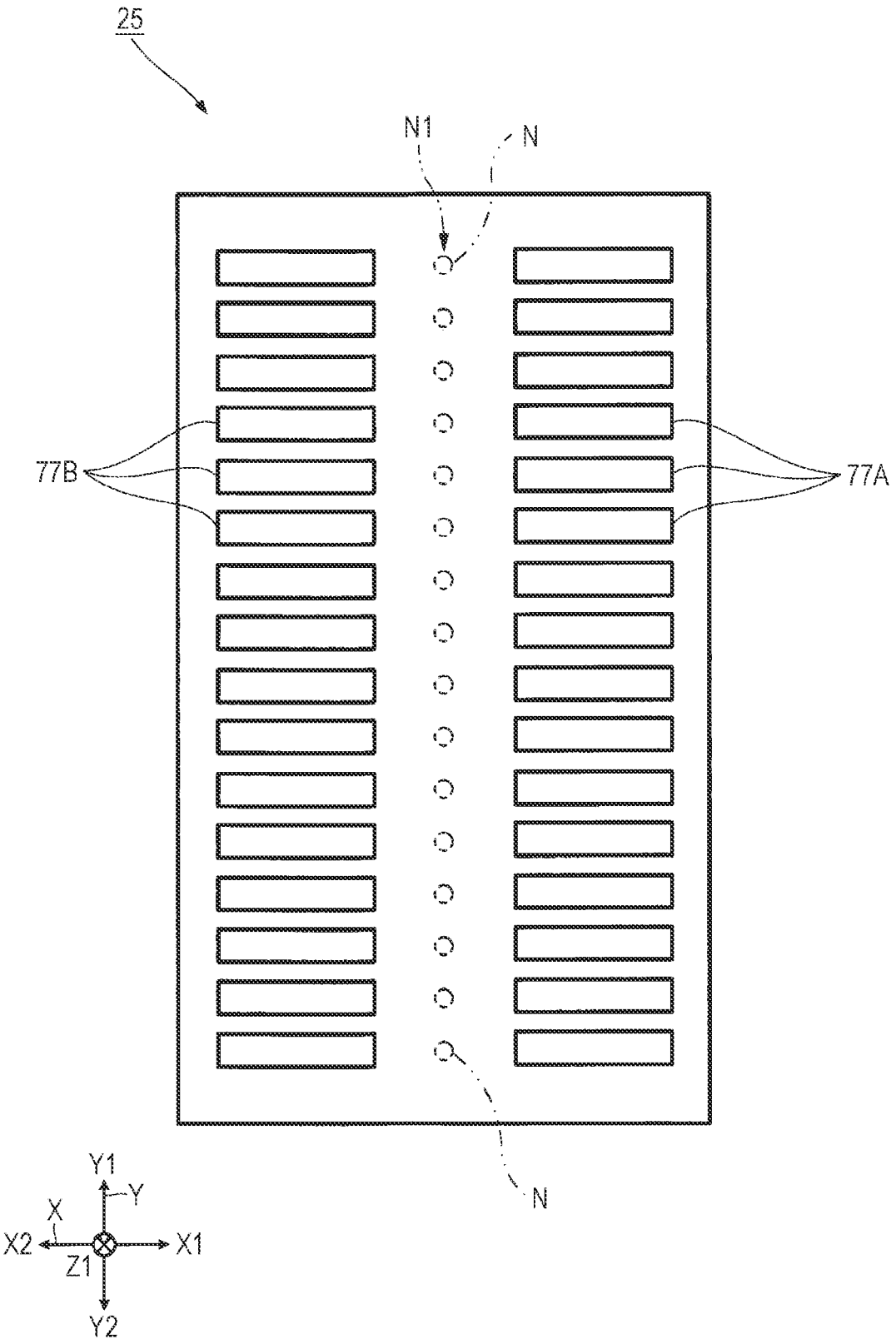
FIG. 5 is a plan view illustrating a pressure chamber formation plate.

FIG. 5 is a plan view illustrating the pressure chamber formation plate 25. In FIG. 5, the position corresponding to the nozzle N is illustrated with a virtual line. As illustrated in FIGS. 2 and 5, the plurality of pressure chambers 77A and 77B are formed in the pressure chamber formation plate 25. The pressure chambers 77A and 77B penetrate the pressure chamber formation plate 25 in the Z axis direction. The pressure chambers 77A and 77B are separated from each other in the X axis direction. The plurality of pressure chambers 77A and 77B are provided for each of the plurality of nozzles N. The plurality of pressure chambers 77A are disposed at predetermined intervals in the Y axis direction. The plurality of pressure chambers 77B are disposed at predetermined intervals in the Y axis direction. The pressure chamber 77A communicates with the relay flow path 75A and the communication flow path 78A. The pressure chamber 77B communicates with the communication flow path 78B and the relay flow path 75B. The pressure chamber formation plate 25 can be manufactured from, for example, a silicon single crystal substrate. The pressure chamber formation plate 25 may be manufactured from other materials.

As illustrated in FIGS. 1 and 2, the vibrating plate 26 is disposed on the upper surface of the pressure chamber formation plate 25. The vibrating plate 26 covers an opening of the pressure chamber formation plate 25. A part of the vibrating plate 26 that covers the opening of the pressure chamber formation plate 25 forms the upper side wall surface of the pressure chambers 77A and 77B. A plurality of piezoelectric actuators 50 are formed on the vibrating plate 26. The piezoelectric actuator 50 is provided for each of the plurality of pressure chambers 77A and 77B.

Figure 6:
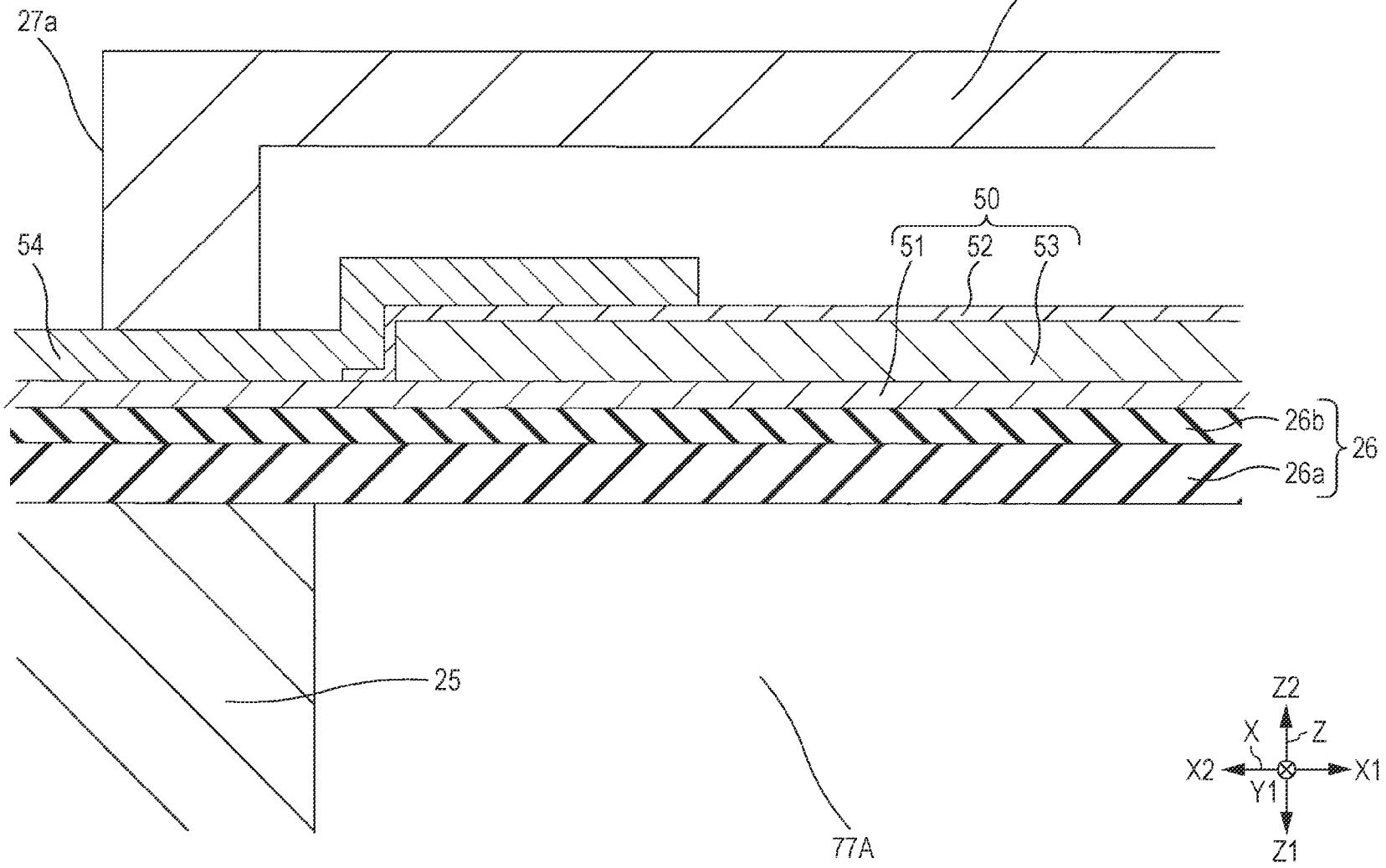
FIG. 6 is an enlarged cross-sectional view illustrating a main portion of a vibrating plate and a piezoelectric actuator.

FIG. 6 is an enlarged cross-sectional view illustrating a main portion of a vibrating plate 26 and a piezoelectric actuator 50. As illustrated in FIG. 6, the vibrating plate 26 is formed with a plurality of insulating layers 26*a* and 26*b*. The vibrating plate 26 includes the insulating layer 26*a* made of silicon dioxide ($SiO_2$) and the insulating layer 26*b* made of zirconium dioxide ($ZrO_2$). The insulating layer 26*a* is formed on the pressure chamber formation plate 25, and the insulating layer 26*b* is formed on the insulating layer 26*a*.

The vibrating plate 26 is driven by the piezoelectric actuator 50 and vibrates in the Z axis direction. The total thickness of the vibrating plate 26 is, for example, 2 μm or less. The total thickness of the vibrating plate 26 may be 15 μm or less, 40 μm or less, or 100 μm or less. For example, when the total thickness of the vibrating plate 26 is 15 μm or less, a resin layer may be included. The vibrating plate 26 may be made of metal. Examples of the metal include stainless steel and nickel. When the vibrating plate 26 is made of metal, the thickness of the vibrating plate 26 may be 15 μm or more or 100 μm or less.

The piezoelectric actuator 50 has electrodes 51 and 52, and a piezoelectric body layer 53. The electrode 51, the piezoelectric body layer 53, and the electrode 52 are laminated in this order on the vibrating plate 26. A piezoelectric body layer 53 is interposed between the electrode 51 and the electrode 52. The electrode 51 is an individual electrode, and the electrode 52 is a common electrode. The electrode 51 may be a common electrode, and the electrode 52 may be an individual electrode. Each of the electrodes 51 is disposed at a position overlapping the plurality of pressure chambers 77A and 77B when viewed in the Z axis direction.

The electrode 51 includes a base layer and an electrode layer. The base layer includes, for example, titanium (Ti). The electrode layer includes a low resistance conductive material such as platinum (Pt) or iridium (Ir). The electrode layer may be formed of an oxide such as strontium ruthenate ($SrRuO_3$) and lanthanum nickelate ($LaNiO_3$). The piezoelectric body layer 53 is disposed so as to cover the plurality of electrodes 51. The piezoelectric body layer 53 is a strip-shaped dielectric film extending in the Y axis direction.

The electrode 52 includes a base layer and an electrode layer. The base layer includes, for example, titanium. The electrode layer includes a low resistance conductive material such as platinum or iridium. The electrode layer may be formed of an oxide such as strontium ruthenate and lanthanum nickelate. Of the piezoelectric body layer 53, a region between the electrodes 51 and 52 is a drive region. The drive regions are respectively formed on each of the plurality of pressure chambers 77A and 77B.

A lead electrode 54 is electrically coupled to the piezoelectric actuator 50. The plurality of lead electrodes 54 extend in the X axis direction and are drawn out into the opening portion 27*a* of the protective substrate 27. The lead electrode 54 is not illustrated in FIGS. 1 and 2. The opening portion 27*a* penetrates the protective substrate 27 in the Z axis direction. When viewed in the Z axis direction, it is electrically coupled to the COF 60 at a position corresponding to the opening portion 27*a*. The lead electrode 54 is made of a conductive material having a lower resistance than the electrode 51. For example, the lead electrode 54 is a conductive pattern having a structure in which a gold (Au) conductive film is laminated on the surface of a conductive film made of nichrome (NiCr).

The protective substrate 27 has a rectangular shape when viewed in the Z axis direction. The protective substrate 27 protects the plurality of piezoelectric actuators 50 and reinforces the mechanical intensity of the pressure chamber formation plate 25 and the vibrating plate 26. The protective substrate 27 is adhered to the vibrating plate 26 with, for example, an adhesive agent.

The COF 60 includes a flexible wiring substrate 61 and a drive circuit 62. The flexible wiring substrate 61 is a wiring substrate having flexibility. The flexible wiring substrate 61 is, for example, an FPC. The flexible wiring substrate 61 may be, for example, an FFC. FPC is an abbreviation for Flexible Printed Circuit. FFC is an abbreviation for Flexible Flat Cable.

The flexible wiring substrate 61 is coupled to the piezoelectric actuator 50 via the lead electrode 54. The flexible wiring substrate 61 is electrically coupled to a circuit substrate (not illustrated). The circuit substrate includes a drive signal generation circuit 32 illustrated in FIG. 25.

The drive circuit 62 is mounted on the flexible wiring substrate 61. The drive circuit 62 includes a switching element for driving the piezoelectric actuator 50. The drive circuit 62 is electrically coupled to the control portion 30 illustrated in FIG. 25 via the flexible wiring substrate 61 and the circuit substrate. The drive circuit 62 receives a drive signal Com output from the drive signal generation circuit 32. The switching element of the drive circuit 62 switches whether or not to supply the drive signal Com generated by the drive signal generation circuit 32 to the piezoelectric actuator 50. The drive circuit 62 supplies a drive voltage or current to the piezoelectric actuator 50 to vibrate the vibrating plate 26.

Figure 7:
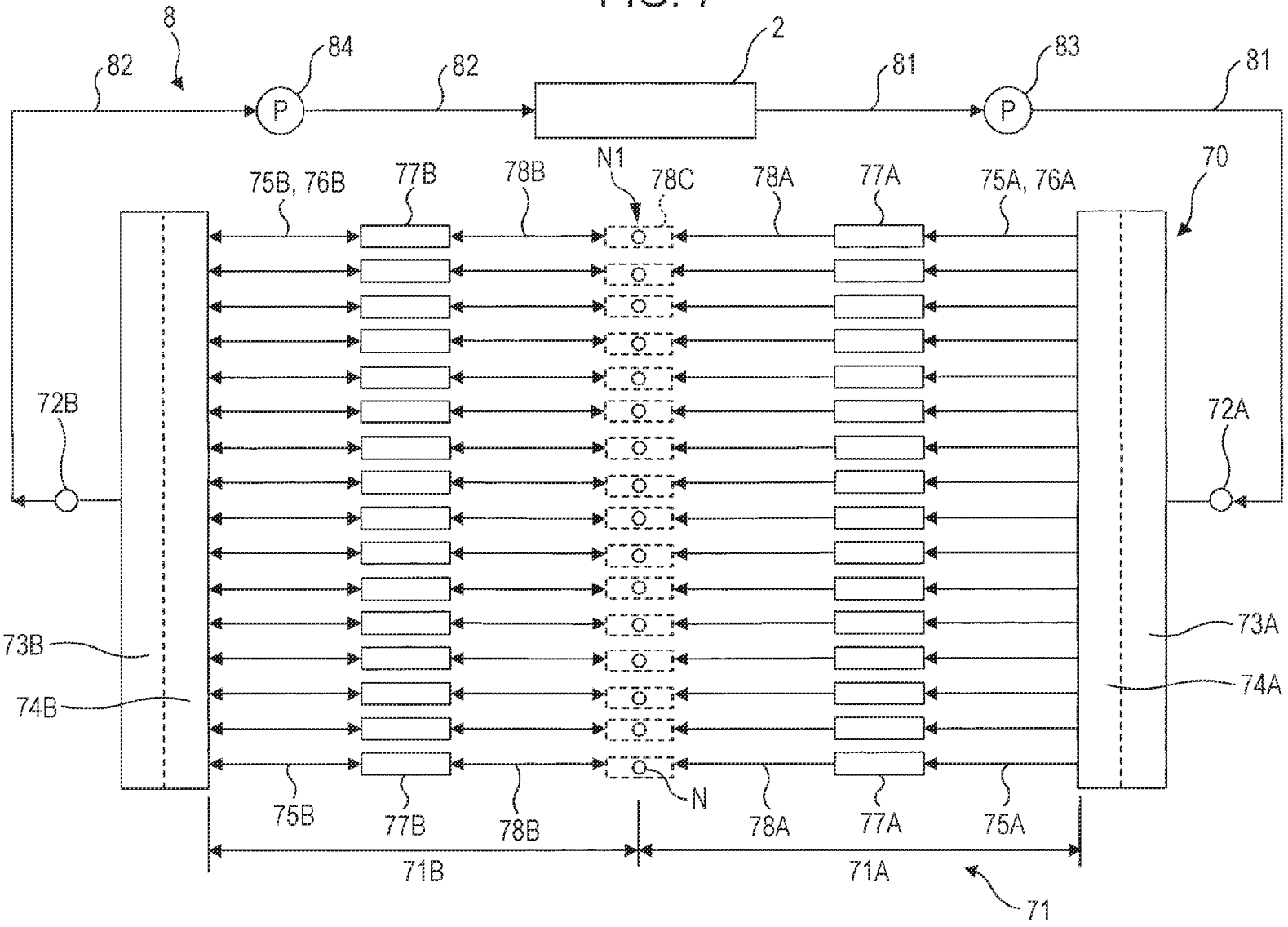
FIG. 7 is a schematic view illustrating a flow of liquid in the liquid discharging head.

FIG. 7 is a schematic view illustrating the flow path of the ink. The liquid discharging apparatus 1 on which the liquid discharging head 20 is mounted includes a circulation mechanism 8 for circulating the ink. The liquid discharging apparatus 1 will be described later with reference to FIG. 24. The circulation mechanism 8 has a supply flow path 81 for supplying the ink to the liquid discharging head 20 and a collection flow path 82 for collecting the ink exhausted from the liquid discharging head 20. The circulation mechanism 8 includes a pump 83 coupled to the supply flow path 81 and a pump 84 coupled to the collection flow path 82. The pumps 83 and 84 are controlled by the control portion 30. The pump 83 supplies the ink to the liquid discharging head 20 from the supply flow path 81. The pump 84 can supply the ink from the collection flow path 82 to the liquid discharging head 20. The liquid discharging apparatus 1 can drive the pump 84 to allow the ink to flow reversely, for example, when the maintenance is performed. Details will be described later.

Figure 8:
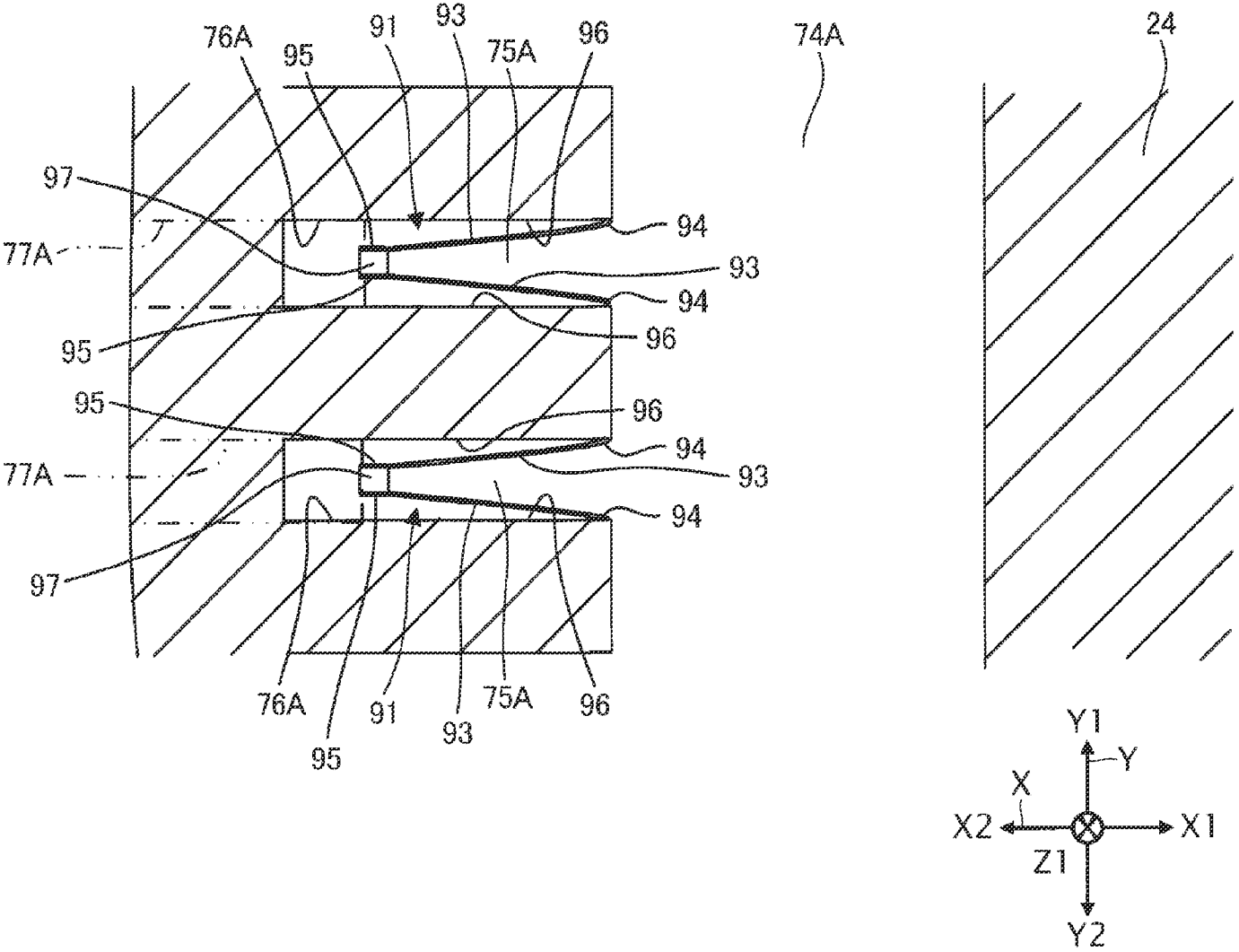
FIG. 8 is a cross-sectional view illustrating a relay flow path provided with an adjustment portion.
Figure 9:
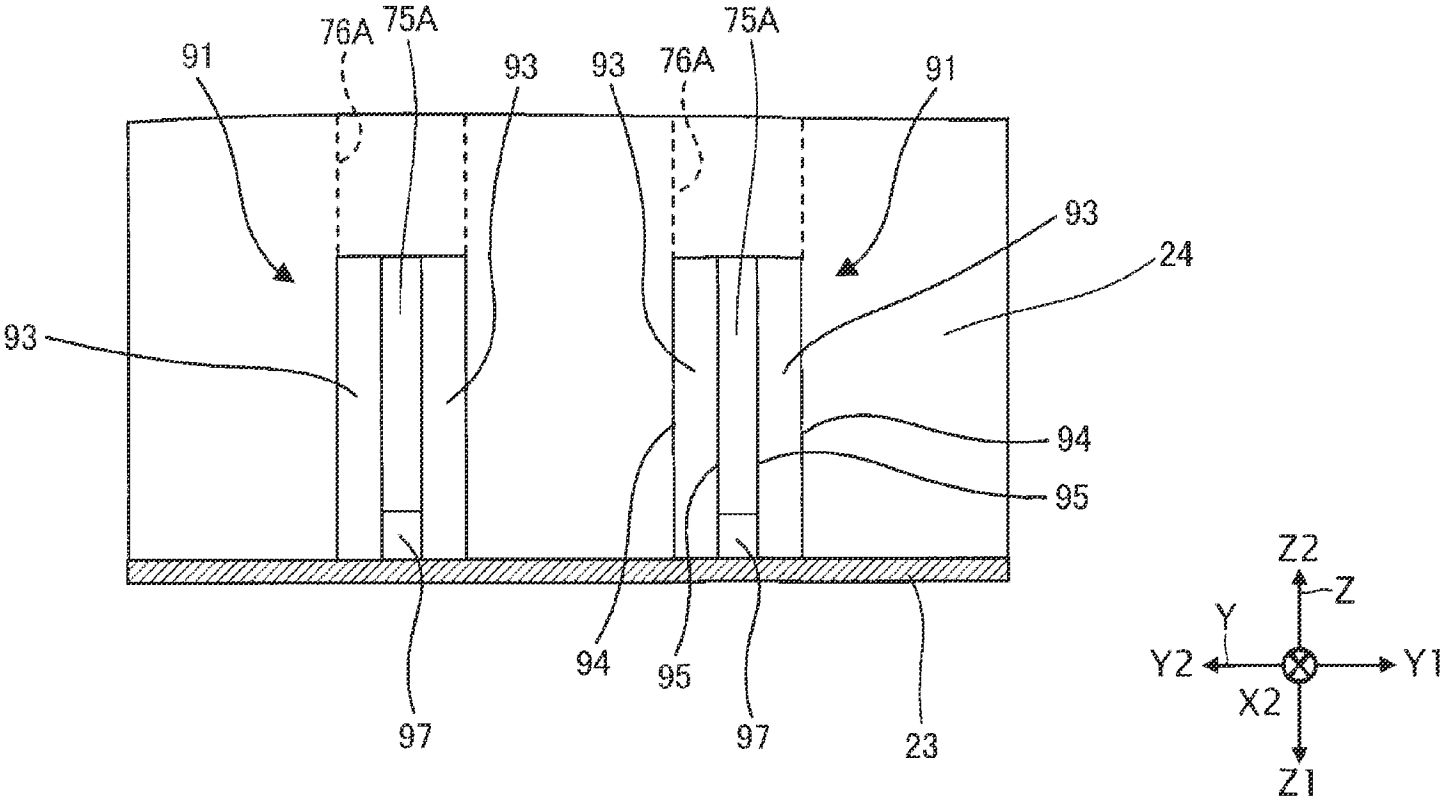
FIG. 9 is a view illustrating the relay flow path provided with the adjustment portion and is a view illustrating a state viewed from the inside of a common liquid chamber.

Next, an adjustment portion 91 provided in the relay flow paths 75A and 75B of the liquid discharging head 20 will be described. As illustrated in FIG. 2, the liquid discharging head 20 includes the adjustment portion 91 that changes a cross-sectional area of the flow path through which the liquid flows. The adjustment portion 91 is provided in the relay flow path 75A, and an adjustment portion 92 is provided in the relay flow path 75B. FIG. 8 is a cross-sectional view illustrating the relay flow path 75A provided with the adjustment portion 91. FIG. 9 is a view illustrating the relay flow path 75A provided with the adjustment portion 91 and is a view illustrating a state viewed from the inside of the common liquid chamber 74.

The adjustment portion 91 is provided between the pressure chamber 77A and the common liquid chamber 74A in the flow path through which the liquid flows. The adjustment portion 91 includes a plurality of leaf springs 93. The plurality of leaf springs 93 are separated from each other in the Y axis direction. The adjustment portion 91 changes a cross-sectional area of the flow path between the leaf springs 93. The leaf spring 93 is long in the direction in which the relay flow path 75A extends. The plate thickness direction of the leaf spring 93 intersects with a direction in which the relay flow path 75A extends. The length of the leaf spring 93 along the longitudinal direction is substantially the same as the length of the relay flow path 75A in the X axis direction. The length of the leaf spring 93 along the longitudinal direction may be shorter than the length of the relay flow path 75A in the X axis direction. The length of the leaf spring 93 along the Z axis direction is substantially the same as the length of the relay flow path 75A in the Z axis direction.

The leaf spring 93 includes end portions 94 and 95 that are separated from each other in the longitudinal direction of the leaf spring 93. The end portion 94 is an end portion closer to the common liquid chamber 74A in the X axis direction. The end portion 95 is an end portion farther from the common liquid chamber 74A in the X axis direction. The end portion 95 is an end portion closer to the pressure chamber 77A. The end portion 94 is a fixed end, and the end portion 95 is a free end. The end portion 94 is fixed with respect to the communication plate 24. The end portion 94 is fixed with respect to an inner wall surface 96 of the relay flow path 75A. The inner wall surface 96 is a wall surface that faces the Y axis direction among the wall surfaces that define the relay flow path 75A. The end portion 95 may be fixed to the other inner wall surface of the communication plate 24.

The end portion 95 is separated from the inner wall surface 96 in the Y axis direction. The end portion 95 is displaceable in the Y axis direction. The end portion 95 is displaceable so as to approach or separate with respect to the inner wall surface 96 in the Y axis direction. The end portion 94 is curved when viewed in the Z axis direction. The end portion 95 is disposed linearly when viewed in the Z axis direction. The end portion 94 may be disposed linearly when viewed in the Z axis direction. The end portion 95 may be formed so as to be curved when viewed in the Z axis direction. The plurality of leaf springs 93 face each other in the Y axis direction. The interval between the end portions 94 of the plurality of leaf springs 93 is larger than the interval between the end portions 95.

The liquid discharging head 20 includes a regulation portion 97 that regulates the displacement of the leaf spring 93 in the plate thickness direction. The regulation portion 97 is provided in the relay flow path 75A. The regulation portion 97 is disposed between the plurality of leaf springs 93 in the Y axis direction. The regulation portion 97 contacts the end portion 95 of the leaf spring 93 to regulate the displacement of the end portion 95. The regulation portion 97 is disposed on the compliance substrate 23, for example. The regulation portion 97 may be formed on the wall surface facing the compliance substrate 23 in the Z axis direction among the inner wall surfaces of the relay flow path 75A.

Figure 10:
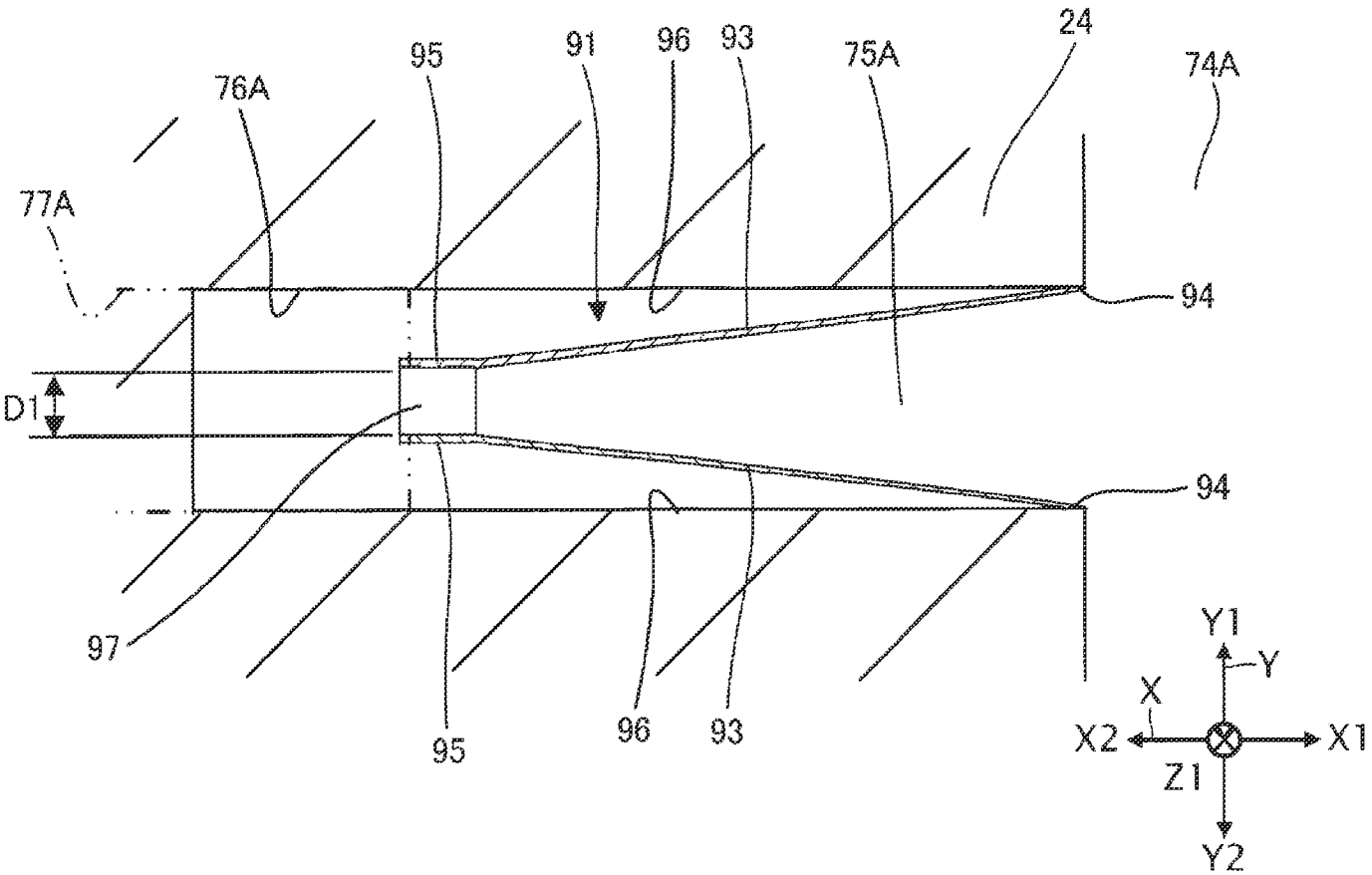
FIG. 10 is a cross-sectional view illustrating the relay flow path and is a view illustrating the adjustment portion when discharging is performed.
Figure 11:
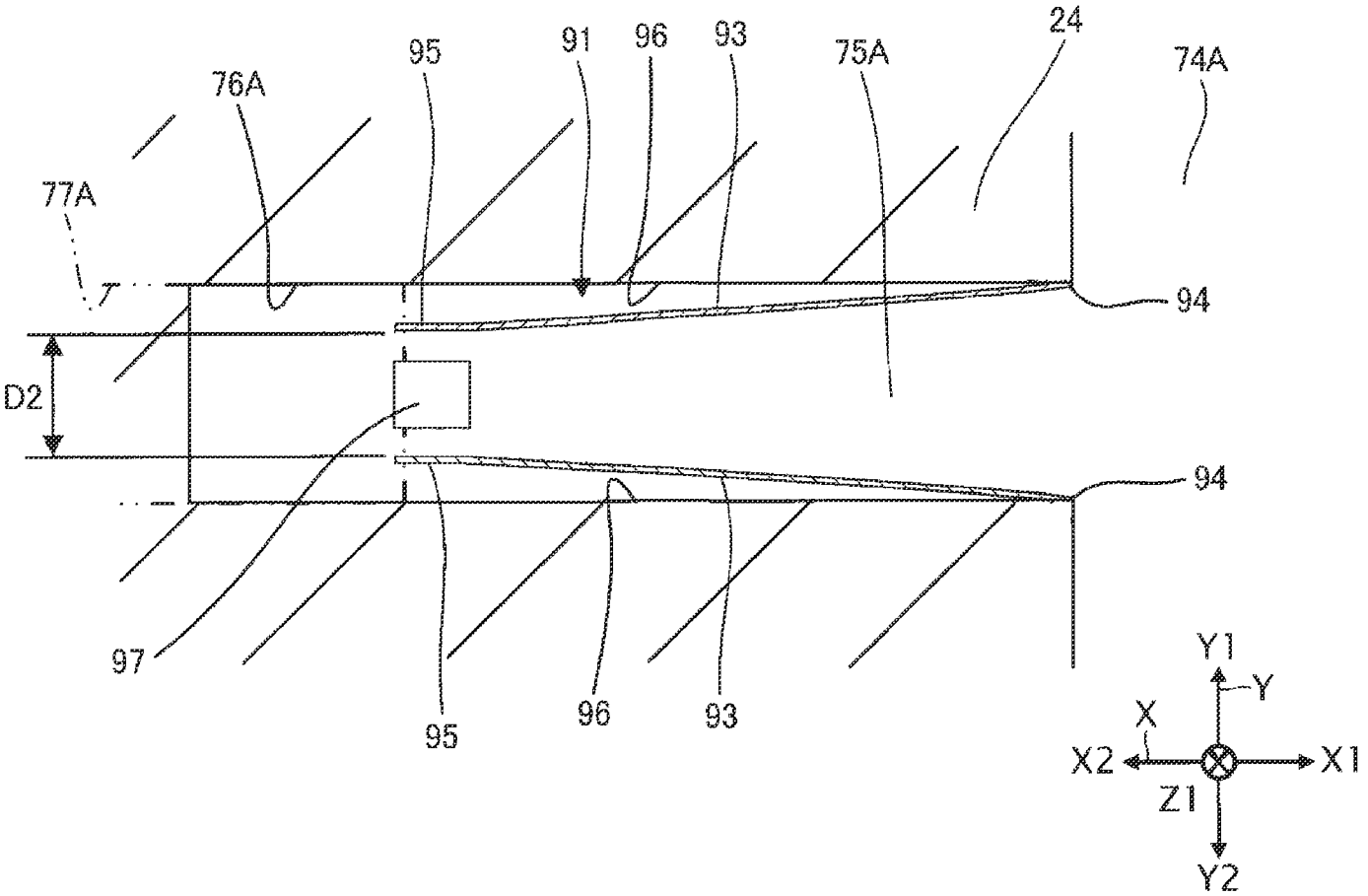
FIG. 11 is a cross-sectional view illustrating the relay flow path and is a view illustrating the adjustment portion when pressurization from the common liquid chamber is performed.

Next, changes in the cross-sectional area of the flow path by the adjustment portion 91 will be described with reference to FIGS. 10 and 11. FIG. 10 is a cross-sectional view illustrating the relay flow path and is a view illustrating the adjustment portion when discharging is performed. FIG. 11 is a cross-sectional view illustrating the relay flow path and is a view illustrating the adjustment portion when pressurization from the common liquid chamber is performed. The adjustment portion 91 displaces the leaf spring 93 to change the cross-sectional area of the flow path. The adjustment portion 91 changes the cross-sectional area of the flow path by changing the distances D1 and D2 between the end portions 95 of the plurality of leaf springs 93 in the Y axis direction.

When the liquid is discharged, the piezoelectric actuator 50 causes a pressure fluctuation in the liquid in the pressure chamber 77A. The liquid inside the pressure chamber 77A passes through the communication flow paths 78A and 78C and is discharged from the nozzle N. The pressure of the liquid inside the pressure chamber 77A is transmitted to the liquid inside the relay flow path 76A opposite side to the nozzle N. The pressure of the liquid inside the relay flow path 76A is transmitted to the liquid inside the relay flow path 75A. The pressure of the liquid inside the relay flow path 75A is transmitted to the liquid inside the common liquid chambers 73A and 74A.

When the liquid is discharged from the nozzle N, as illustrated in FIG. 10, the plurality of leaf springs 93 are disposed so as to approach each other in the Y axis direction. The end portions 95 of the leaf springs 93 approach each other in the Y axis direction. When the pressure of the liquid inside the pressure chamber 77A is increased, the distance between the end portions 95 may be almost unchanged. When the discharging is performed, the end portion 95 is in contact with the regulation portion 97. When the discharging is performed, the displacement of the end portion 95 in the direction separated from the inner wall surface 96 is reduced.

When the liquid is pressurized from the common liquid chambers 73A and 74A, for example, the liquid inside the common liquid chambers 73A and 74A is pressurized from the supply port 72A by driving the pump 83. For example, when the maintenance is performed, the liquid can be pressurized from the common liquid chambers 73A and 74A by circulating the liquid. The pressure of the liquid inside the common liquid chamber 74A is transmitted to the liquid inside the relay flow path 75A. The pressure of the liquid inside the relay flow path 75A is transmitted to the liquid inside the relay flow path 76A.

When the liquid inside the relay flow path 75A is pressurized from the common liquid chamber 74, the leaf spring 93 is displaced so as to approach the inner wall surface 96 as illustrated in FIG. 11 by the pressure of the liquid inside the relay flow path 75A. The end portions 95 of the leaf springs 93 are displaced so as to be separated from each other in the Y axis direction. The flow path is widened by the liquid inside the relay flow path 75 such that the leaf springs 93 are separated from each other. The end portion 95 is displaced so as to be separated from the regulation portion 97 and approach the inner wall surface 96. When the pressurization from the common liquid chamber 74A is performed, a distance D2 between the end portions 95 becomes larger than a distance D1 illustrated in FIG. 10. When the pressure of the liquid inside the common liquid chamber 74 is increased, the distance D2 between the end portions 95 becomes even larger. The cross-sectional area of the flow path between the plurality of leaf springs 93 is increased as the pressure inside the common liquid chamber 74 is increased.

For example, when the liquid inside the common liquid chamber 74A is pressurized so as to have a pressure P1, the cross-sectional area of the flow path between the end portions 95 of the leaf spring 93 becomes a cross-sectional area S1. When the liquid inside the common liquid chamber 74A is pressurized so as to have a pressure P2 higher than the pressure P1, the cross-sectional area of the flow path between the end portions 95 becomes a cross-sectional area S2 larger than the cross-sectional area S1.

For example, when the liquid inside the pressure chamber 77A is pressurized so as to have a pressure P3, the cross-sectional area of the flow path between the end portions 95 of the leaf spring 93 becomes a cross-sectional area S3. The cross-sectional area of the flow path between the end portions 95 when the liquid inside the pressure chamber 77A is pressurized so as to have a pressure P4 higher than the pressure P3 is a cross-sectional area S4. The cross-sectional area S3 and the cross-sectional area S4 may be the same. The term the "same" as used herein includes substantially the same and includes cases where it can be regarded as substantially the same. The cross-sectional area S4 may be larger than the cross-sectional area S3. A difference between the cross-sectional area S2 and the cross-sectional area S1 is larger than a difference between the cross-sectional area S4 and the cross-sectional area S3.

Figure 12:
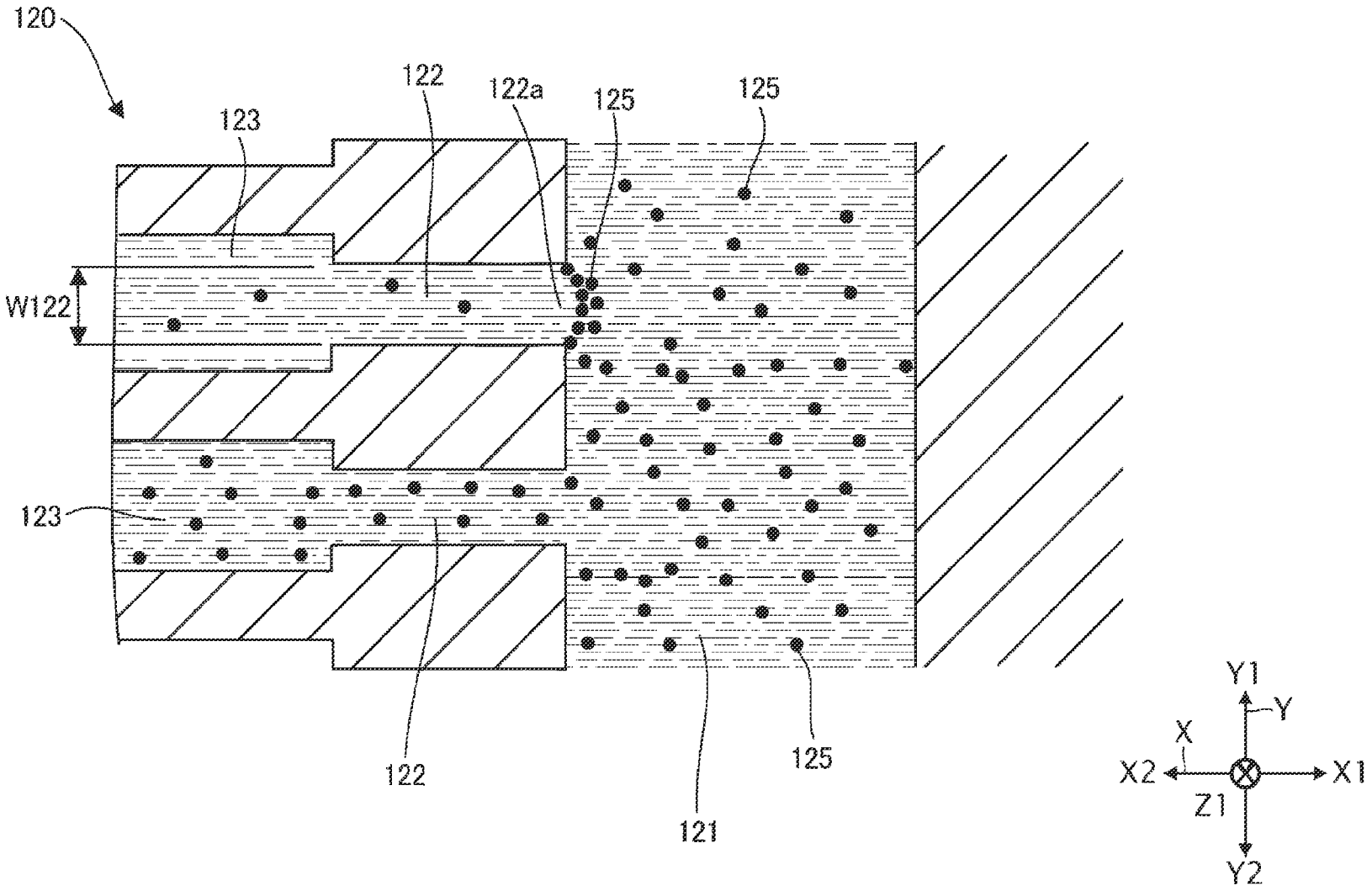
FIG. 12 is a cross-sectional view illustrating the liquid discharging head according to the related art and is a view illustrating a case where clogging caused by particles occurs at a boundary between the relay flow path and the common liquid chamber.

Next, with reference to FIG. 12, the clogging caused by the particles 125 in the liquid discharging head 120 according to the related art will be described. As illustrated in FIG. 12, the liquid discharging head 120 includes the common liquid chamber 121, the plurality of relay flow paths 122, and the plurality of pressure chambers 123. The liquid inside the common liquid chamber 121 passes through the plurality of relay flow paths 122 and is distributed to each of the plurality of pressure chambers 123.

The cross section of the relay flow path 122 is narrower than the cross section of the common liquid chamber 121. The "cross section" here is a cross section orthogonal to the flow direction of the liquid. In the related art, particles in the liquid may be clogged at the inlet 122*a* of the relay flow path 122. The inlet 122*a* is positioned at the boundary between the relay flow path 122 and the common liquid chamber 121. As illustrated in FIG. 12, in the related art, particles may stay at the inlet 122*a* and the flow path may be clogged. The particles 125 may be accumulated so as to rise toward the inside of the common liquid chamber 121, for example. For example, in a case where the particles are clogged at the inlet 122*a*, even when the pump 83 is used to pressurize the liquid from the common liquid chamber 121, the clogging caused by the particles may not be eliminated and the particles 125 may be further adhered to each other.

Similarly, even when a suction pump is coupled to the nozzle N and the ink is sucked from the nozzle N, the clogging caused by the particles is not eliminated at the inlet 122*a*, and the particles 125 may further adhere to each other. In a case where the liquid is pressurized from the common liquid chamber 121 toward the pressure chamber 123 through the relay flow path 122 when the particles are clogged, only the liquid flows through the gap between the particles 125. Due to this flow, the adhesion between the particles 125 becomes stronger, and there is a possibility that the clogging caused by the particles 125 cannot be eliminated.

A probability of occurrence of clogging caused by the particles 125 correlates with the ratio of the minimum width W122 of the relay flow path 122 to the particle diameter of the particle 125. The smaller the ratio of the minimum width W122 to the particle diameter, the higher the probability of occurrence of clogging caused by the particles 125 in a series. For example, in order to reduce the probability of occurrence of clogging caused by the particles, it is desirable to set the minimum width W122 to be 10 times or more than the particle diameter. However, in a case where the minimum width W122 of the relay flow path 122 is increased, when the liquid inside the pressure chamber 123 is pressurized to discharge the liquid, the pressure of the liquid inside the pressure chamber 123 escapes to the common liquid chamber 121 through the relay flow path 122, and then there arises a problem that the liquid cannot be efficiently discharged from the nozzle N.

According to the liquid discharging head 20 of the present embodiment, since the adjustment portion 91 that changes the cross-sectional area of the flow path is provided in the relay flow path 75A, the cross-sectional area of the flow path can be changed between the pressure chamber 77A and the common liquid chamber 74A. In the liquid discharging head 20, the cross-sectional area of the flow path can be changed between when the discharging of the liquid from the nozzle N is performed and when the pressurization from the common liquid chamber 74A is performed. In the liquid discharging head 20, in the case where the pressurization from the common liquid chamber 74A is performed, the cross-sectional area of the flow path can be widened, and in the case where the discharging of the liquid is performed, the cross-sectional area of the flow path can be made narrower than when the pressurization from the common liquid chamber 74A is performed. In the liquid discharging head 20, when the liquid is made to flow from the common liquid chamber 74A into the pressure chamber 77A, the probability of occurrence of clogging caused by the particles can be reduced by increasing the cross-sectional area of the flow path by the adjustment portion 91. In the liquid discharging head 20, since the cross-sectional area of the flow path by the adjustment portion 91 can be narrowed when the discharging is performed, it is possible to prevent the pressure of the liquid from escaping into the common liquid chamber 74A. In the liquid discharging head 20, the piezoelectric actuator 50 can be driven to increase the pressure inside the pressure chamber 77A, and the liquid can be reliably discharged from the nozzle N. The liquid discharging head 20 can reduce the clogging of the flow path caused by the particles and can reliably discharge the liquid from the nozzle N.

In the liquid discharging head 20, for example, when the maintenance is performed, the liquid inside the relay flow path 75A can be pressurized from the common liquid chamber 74A by circulating the liquid from the common liquid chambers 73A and 74A toward the pressure chamber 77A. When the pressurization is performed, the distance between the leaf springs 93 can be increased to increase the cross-sectional area of the flow path between the leaf springs 93 by pressurizing the liquid inside the common liquid chamber 74A at the pressure P2 higher than the pressure P1. The cross-sectional area of the flow path between the leaf springs 93 is increased from, for example, the cross-sectional area S1 to the cross-sectional area S2. In the liquid discharging head 20, the clogging caused by the particles can be reduced by pressurizing the liquid from the common liquid chamber 74A when the maintenance is performed.

In the liquid discharging head 20, the piezoelectric actuator 50 can be driven to make the pressure of the liquid inside the pressure chambers 77A and 77B fluctuate, and the liquid can be discharged from the nozzle N. When the pressure of the liquid inside the pressure chamber 77A fluctuates from the pressure P3 to a pressure P higher than the pressure P3, the cross-sectional area of the flow path between the leaf springs 93 changes from the cross-sectional area S3 to the cross-sectional area S4. The change from the cross-sectional area S3 to the cross-sectional area S4 is smaller than the change from the cross-sectional area S1 to the cross-sectional area S2. The change in the cross-sectional area of the flow path of the adjustment portion 91 when the liquid is pressurized from the pressure chamber 77A is smaller than the change in the cross-sectional area of the flow path of the adjustment portion 91 when the liquid is pressurized from the common liquid chamber 74A. As a result, in the liquid discharging head 20, the pressure decrease inside the pressure chamber 77A can be reduced and the liquid can be reliably discharged from the nozzle N.

In a case where the pressure of the liquid inside the common liquid chamber 74A is higher than the pressure inside the pressure chamber 77A, the adjustment portion 91 can change the cross-sectional area of the flow path to be the cross-sectional area S1 when a pressure difference ΔP, which is a difference between the pressure inside the common liquid chamber 74A and the pressure of the liquid inside the pressure chamber 77A, is a first pressure difference ΔP1. The adjustment portion 91 can change the cross-sectional area of the flow path to be a second cross-sectional area S2 larger than the first cross-sectional area S1 when the pressure difference ΔP is a second pressure difference ΔP2 larger than the first pressure difference ΔP1. The adjustment portion 91 can adjust the cross-sectional area of the flow path in this way.

In a case where the pressure of the liquid inside the pressure chamber 77A is higher than the pressure of the liquid inside the common liquid chamber 74A, the adjustment portion 91 changes the cross-sectional area such that the cross-sectional area of the flow path by the adjustment portion 91 becomes a third cross-sectional area S3 when the pressure difference ΔP is a third pressure difference ΔP3, and the cross-sectional area becomes a fourth cross-sectional area S4 when the pressure difference ΔP is a fourth pressure difference ΔP4 larger than the third pressure difference ΔP3. In this case, a difference between the third cross-sectional area S3 and the fourth cross-sectional area S4 is smaller than a difference between the first cross-sectional area S1 and the second cross-sectional area S2. The third cross-sectional area S3 is substantially equal to the fourth cross-sectional area S4. The third cross-sectional area S3 may be equal to the fourth cross-sectional area S4. A difference between the third pressure difference ΔP3 and the fourth pressure difference ΔP4 is substantially equal to a difference between the first pressure difference ΔP1 and the second pressure difference ΔP2. A difference between the third pressure difference ΔP3 and the fourth pressure difference ΔP4 may be equal to a difference between the first pressure difference ΔP1 and the second pressure difference ΔP2.

Figure 13:
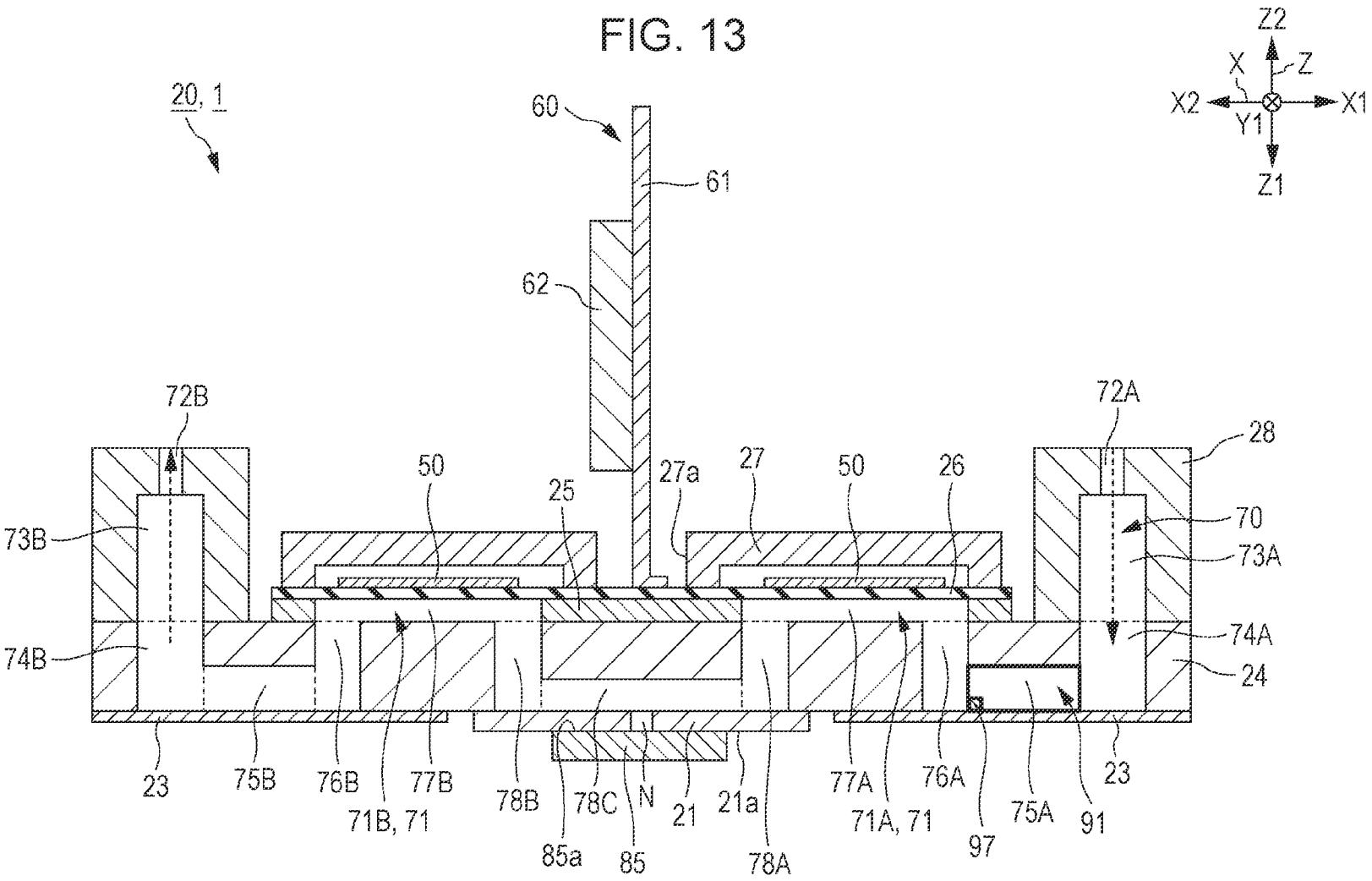
FIG. 13 is a cross-sectional view illustrating the liquid discharging head in a state in which a nozzle is sealed.

Next, with reference to FIG. 13, a case where the pressurization from the common liquid chambers 73A and 74A is performed in the state in which the nozzle N is sealed will be described. FIG. 13 is a cross-sectional view illustrating the liquid discharging head 20 in the state in which the nozzle N is sealed. The liquid discharging apparatus 1 provided with the liquid discharging head 20 may include a sealing portion 85 for sealing the nozzle N. The sealing portion 85 has a surface 85*a* that is in contact with the nozzle surface 21*a* of the nozzle plate 21. The surface 85*a* is in contact with the nozzle surface 21*a* to seal the nozzle N. The surface 85*a* has a predetermined length in the Y axis direction and can cover the plurality of nozzles N.

The liquid discharging apparatus 1 can circulate the liquid in the state in which the plurality of nozzles N are sealed by the sealing portion 85, for example, when the maintenance is performed. The liquid is supplied into the liquid discharging head 20 from the supply port 72A. The liquid that passes through the flow path 70 is exhausted from the exhaust port 72B. The liquid exhausted from the exhaust port 72B is again supplied into the liquid discharging head 20 from the supply port 72A. In this case, since the nozzle N is sealed, the liquid can be circulated at a higher pressure as compared with the state in which the nozzle N is not sealed. By performing the pressurization from the common liquid chamber 74A at a higher pressure, the cross-sectional area can be made larger, so that the clogging caused by the particles can be reduced. Further, the liquid discharging apparatus 1 may have the direction in which the liquid flows in the opposite direction. The liquid discharging apparatus 1 may alternately perform a normal flow in which the liquid flows in from the supply port 72A and a reverse flow in which the liquid flows in from the exhaust port 72B. By changing the direction of the liquid flowing inside the flow path 70 in the opposite direction, pressurization can be performed from different directions.

In the related art, there are restrictions on the particle diameter of the particles included in the liquid in order to prevent the clogging caused by the particles. However, in the liquid discharging apparatus 1, since the clogging caused by particles is reduced, the liquid including particles having a larger particle diameter than that of in the related art can be used. Similarly, in the related art, there are restrictions on the particle concentration of the particles included in the liquid in order to prevent the clogging caused by the particles. However, in the liquid discharging head 20, since the clogging caused by particles is reduced, the liquid including particles having a higher particle concentration than that of in the related art can be used.

Next, the average particle diameter of the coloring material included in the liquid will be described. The average particle diameter of the coloring material included in the liquid is, for example, 2 μm or more. The average particle diameter is more preferably 4.5 μm or more. The average particle diameter of the coloring material included in the liquid is, for example, 10 μm or less. The average particle diameter can be calculated by using, for example, the particle diameter measurement method according to JIS Z8825. The average particle diameter may be a value measured by using another method such as an image analysis method or a centrifugal sedimentation method. Since the liquid discharging apparatus 1 can reduce the clogging caused by particles, it is possible to use a liquid including particles having a larger particle diameter as compared with that of the related art.

Figure 14:
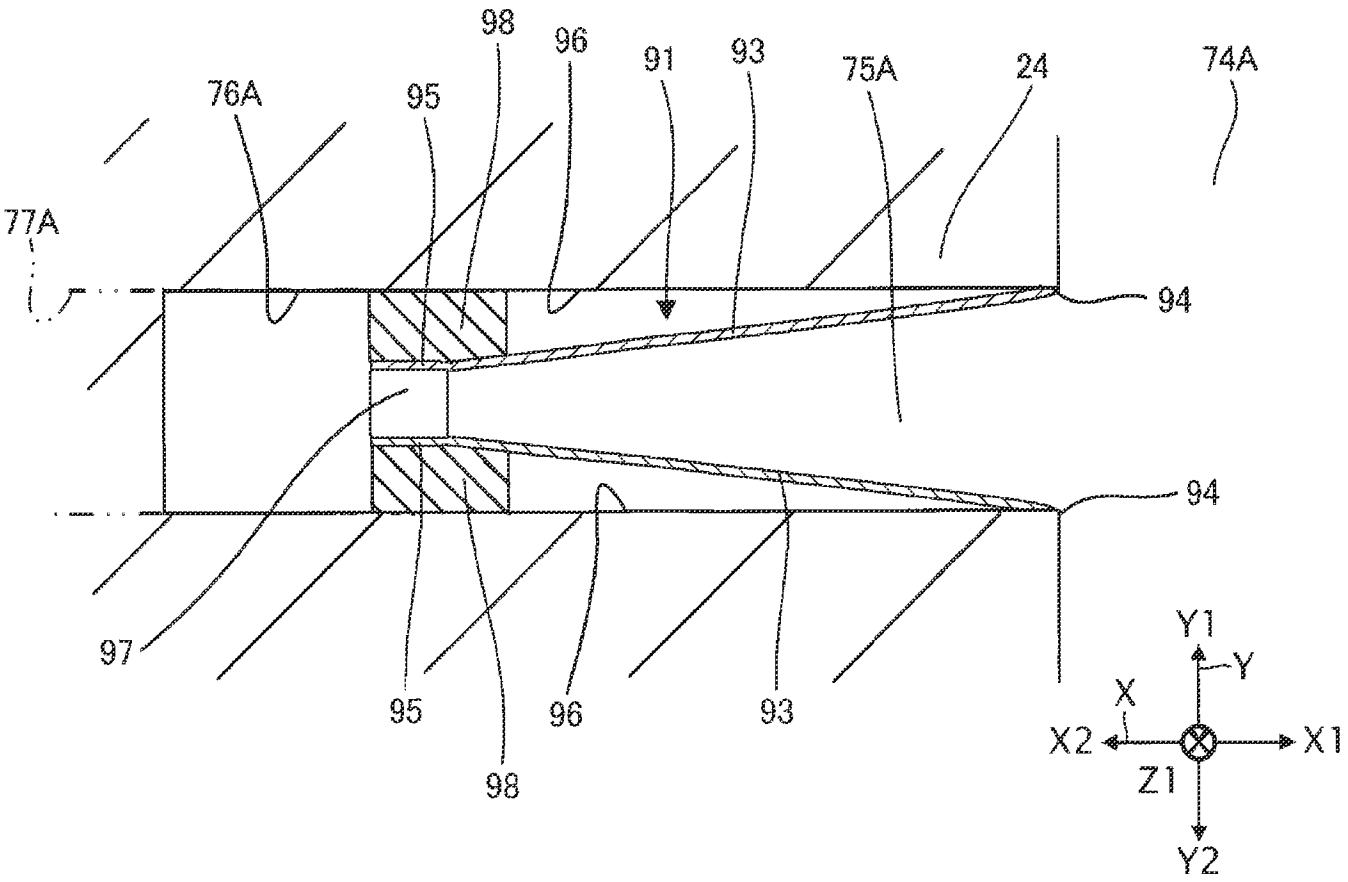
FIG. 14 is a cross-sectional view illustrating the relay flow path of the liquid discharging head according to Example 1 and is a view illustrating a state of the adjustment portion when discharging is performed.
Figure 15:
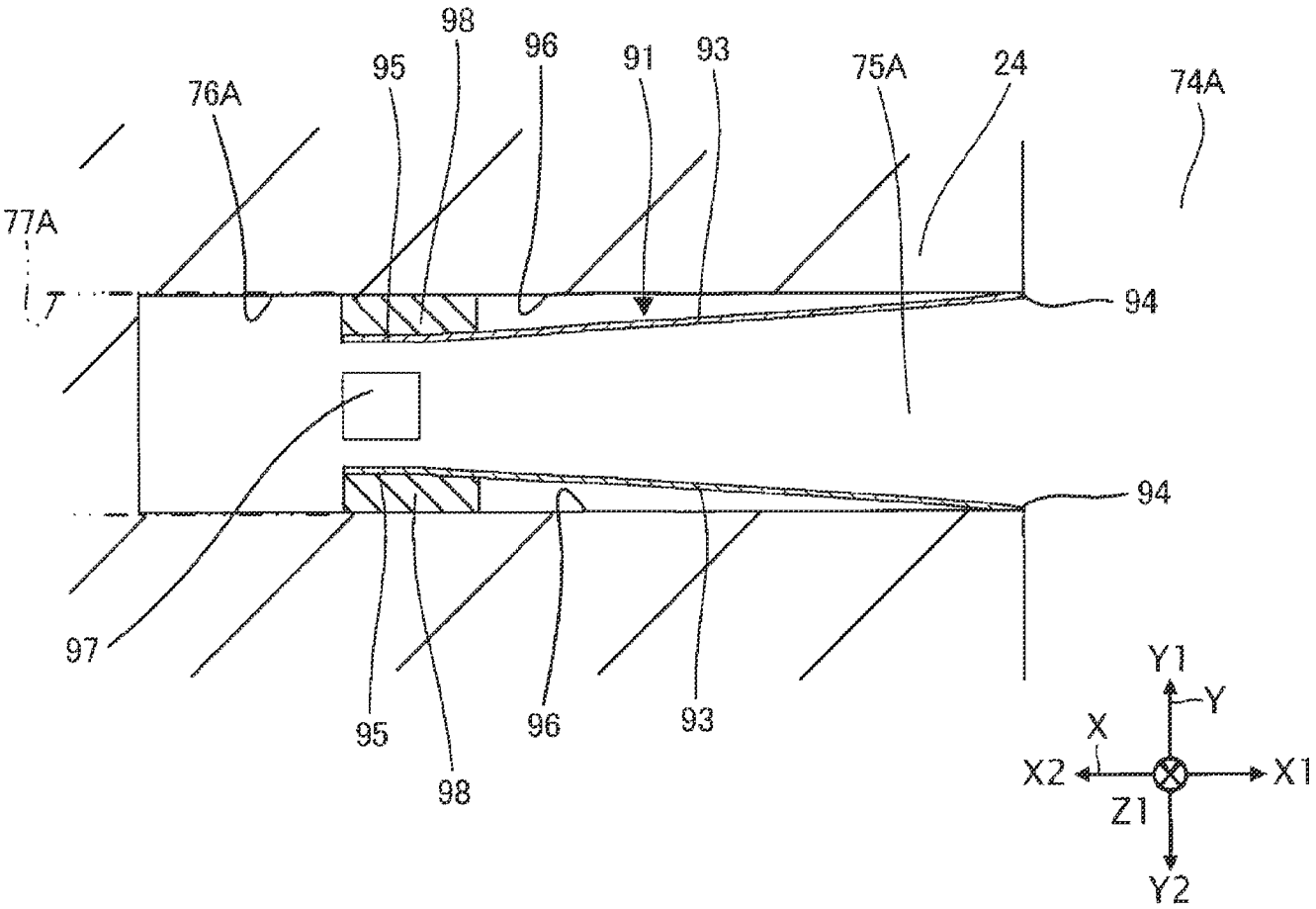
FIG. 15 is a cross-sectional view illustrating the relay flow path of the liquid discharging head according to Example 1 and is a view illustrating a state of the adjustment portion when pressurization from the common liquid chamber is performed.

Next, the liquid discharging head 20 provided with the adjustment portion 91 according to Example 1 will be described with reference to FIGS. 14 and 15. FIGS. 14 and 15 are cross-sectional views illustrating the relay flow path 75A of the liquid discharging head 20 provided with the adjustment portion 91 according to Example 1. FIG. 14 is a view illustrating a state of the adjustment portion 91 when the discharging is performed. FIG. 15 is a view illustrating a state of the adjustment portion 91 when the pressurization from the common liquid chamber 74A is performed. The adjustment portion 91 according to Example 1 includes an elastically deformable filler 98.

The filler 98 is disposed between the leaf spring 93 and the inner wall surface 96 of the relay flow path 75A. The inner wall surface 96 is an inner wall surface 96 present in a direction in which the leaf spring 93 moves when the cross-sectional area of the flow path is expanded. The filler 98 is in contact with the end portion 95 and the inner wall surface 96. The filler 98 is formed of, for example, a flexible silicone resin. The filler 98 seals a gap between the leaf spring 93 and the inner wall surface 96. The filler 98 is elastically deformed according to the displacement of the leaf spring 93.

When the liquid is discharged from the nozzle N, as illustrated in FIG. 14, the leaf spring 93 is displaced so as to be separated from the inner wall surface 96, and the filler 98 is extended. When the liquid is pressurized from the common liquid chamber 74A, as illustrated in FIG. 15, the leaf spring 93 is displaced so as to approach the inner wall surface 96, and the filler 98 is compressed.

Since the adjustment portion 91 according to Example 1 includes the filler 98, it is possible to prevent the liquid from entering the gap between the inner wall surface 96 and the leaf spring 93. As a result, it is possible to prevent the liquid from staying in the dead space between the leaf spring 93 and the inner wall surface 96. For example, it is possible to prevent the particles included in the liquid from entering the gap between the leaf spring 93 and the inner wall surface 96.

Figure 16:
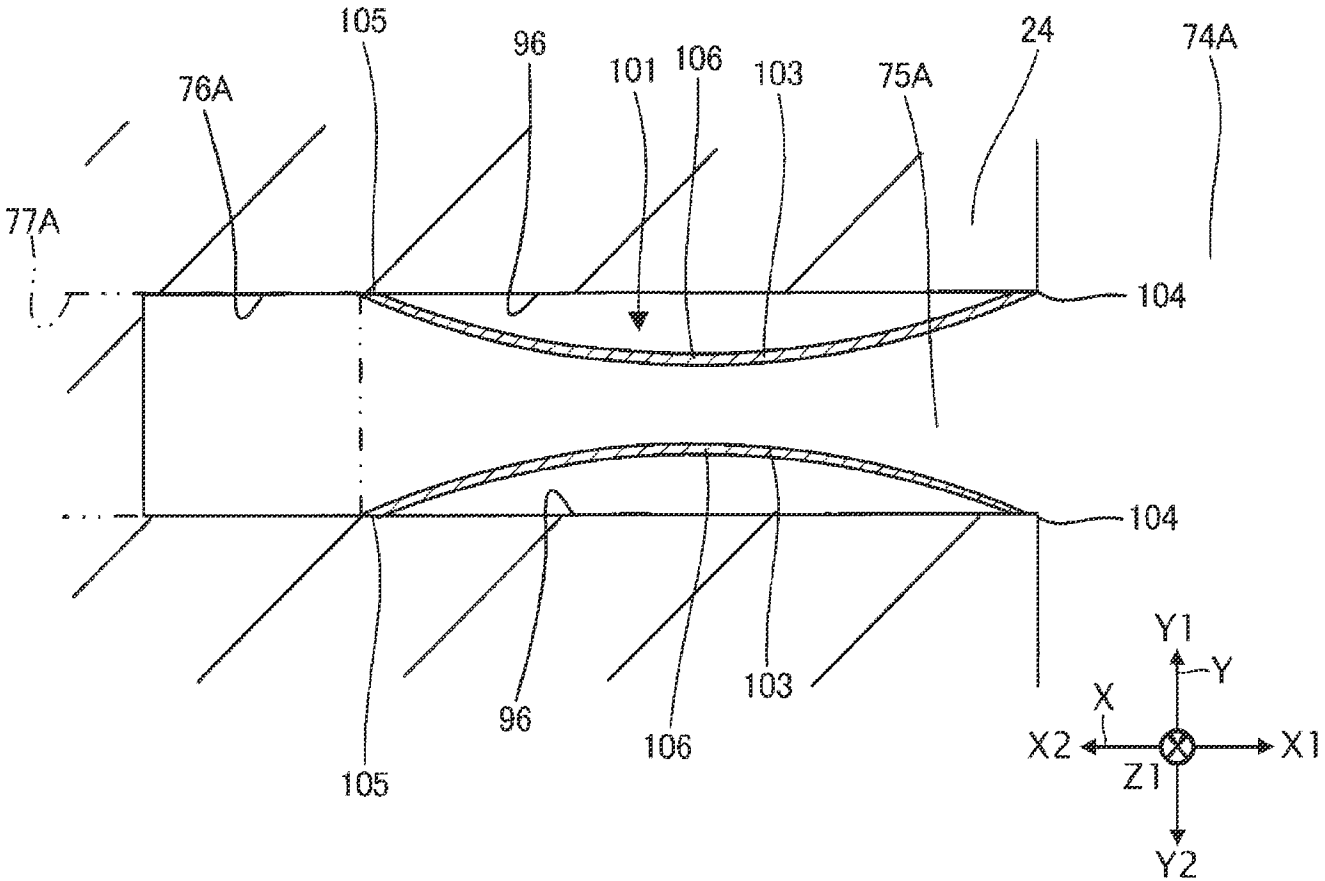
FIG. 16 is a cross-sectional view illustrating the relay flow path of the liquid discharging head according to Example 2.

Next, the liquid discharging head 20 provided with the adjustment portion 101 according to Example 2 will be described with reference to FIG. 16. FIG. 16 is a cross-sectional view illustrating the relay flow path 75A of the liquid discharging head 20 provided with the adjustment portion 101 according to Example 2. The liquid discharging head 20 may include the adjustment portion 101 instead of the adjustment portion 91. The adjustment portion 101 includes the plurality of leaf springs 103.

The leaf spring 103 is long in the X axis direction. The plate thickness direction of the leaf spring 103 is substantially along the Y axis direction. The plate thickness direction of the leaf spring 103 may be along the other direction. The leaf spring 103 has end portions 104 and 105 that are separated from each other in the longitudinal direction. The end portion 104 is an end portion closer to the common liquid chamber 74A. The end portion 105 is an end portion farther from the common liquid chamber 74A. The end portion 105 is an end portion closer to the pressure chamber 77A. The end portion 104 and the end portion 105 are fixed ends and are fixed to the inner wall surface 96. The end portion 104 and the end portion 105 are fixed with respect to the communication plate 24.

The leaf spring 103 is curved when viewed from the Z axis direction. A central portion 106 in the longitudinal direction of the leaf spring 103 is separated from the inner wall surface 96. The cross-sectional area between the central portions 106 of the plurality of leaf springs 103 is the narrowest in the flow path of the adjustment portion 101. The central portion 106 is displaced so as to approach and separate with respect to the inner wall surface 96. For example, when the pressure of the liquid inside the common liquid chamber 74A is increased from the first pressure P1 to the second pressure P2, the central portion 106 is displaced so as to approach the inner wall surface 96. The leaf spring 103 is deformed such that the cross-sectional area of the flow path of the adjustment portion 101 becomes large. For example, when the pressure of the liquid inside the common liquid chamber 74A is decreased from the second pressure P2 to the first pressure P1, the central portion 106 is displaced so as to be separated from the inner wall surface 96. The leaf spring 103 is deformed such that the cross-sectional area of the flow path of the adjustment portion 101 becomes small. In the liquid discharging head 20, for example, when there is the clogging caused by the particles, the cross-sectional area of the flow path can be changed by pressurizing the liquid from the common liquid chamber 74A, and the clogging caused by the particles can be eliminated.

Figure 17:
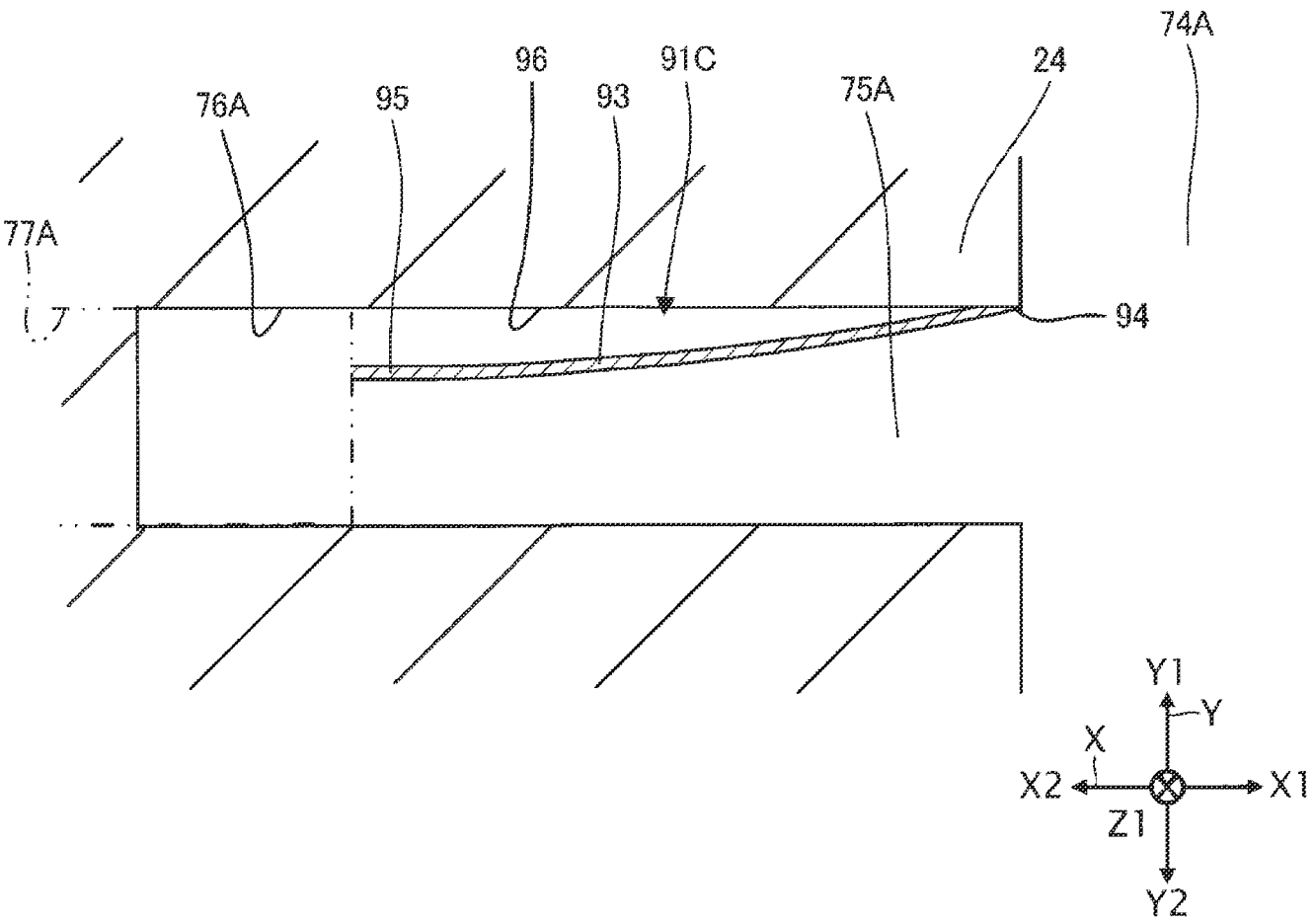
FIG. 17 is a cross-sectional view illustrating the relay flow path of the liquid discharging head according to Example 3.

Next, the liquid discharging head 20 provided with the adjustment portion 91C according to Example 3 will be described with reference to FIG. 17. FIG. 17 is a cross-sectional view illustrating the relay flow path 75A of the liquid discharging head 20 provided with the adjustment portion 91C according to Example 3. The liquid discharging head 20 may include the adjustment portion 91C instead of the adjustment portion 91. The difference between the adjustment portion 91C and the adjustment portion 91 is that it has only one leaf spring 93. As described above, the adjustment portion 91C may have one leaf spring 93. The direction in which the leaf spring 93 is displaced is not limited to the Y axis direction, and any other direction can be used. For example, the leaf spring 93 may be fixed with respect to a surface intersecting in the Z axis direction and displaced in the Z axis direction among the inner wall surfaces of the relay flow path 75A.

Figure 18:
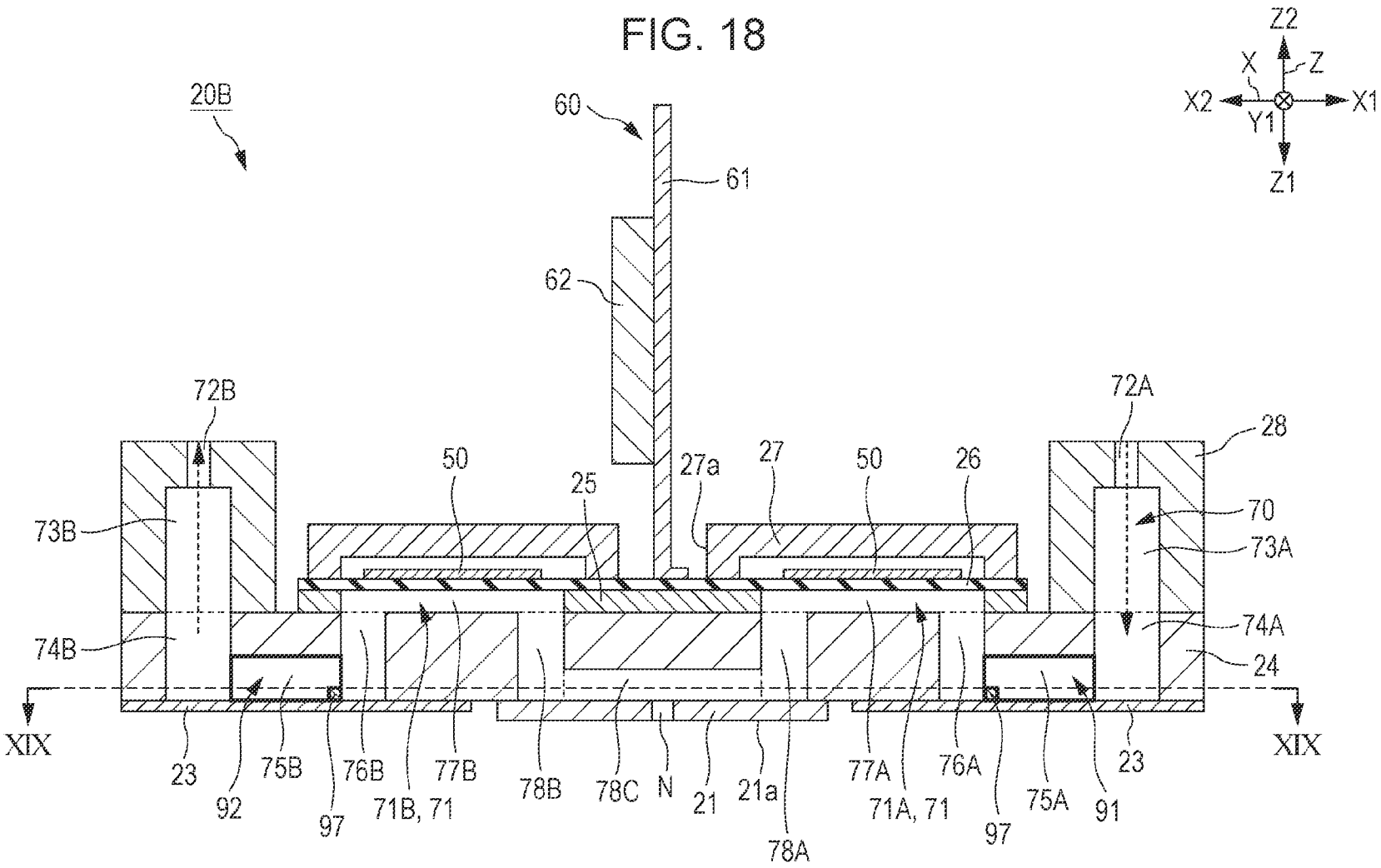
FIG. 18 is a cross-sectional view illustrating a liquid discharging head according to a second embodiment.
Figure 19:
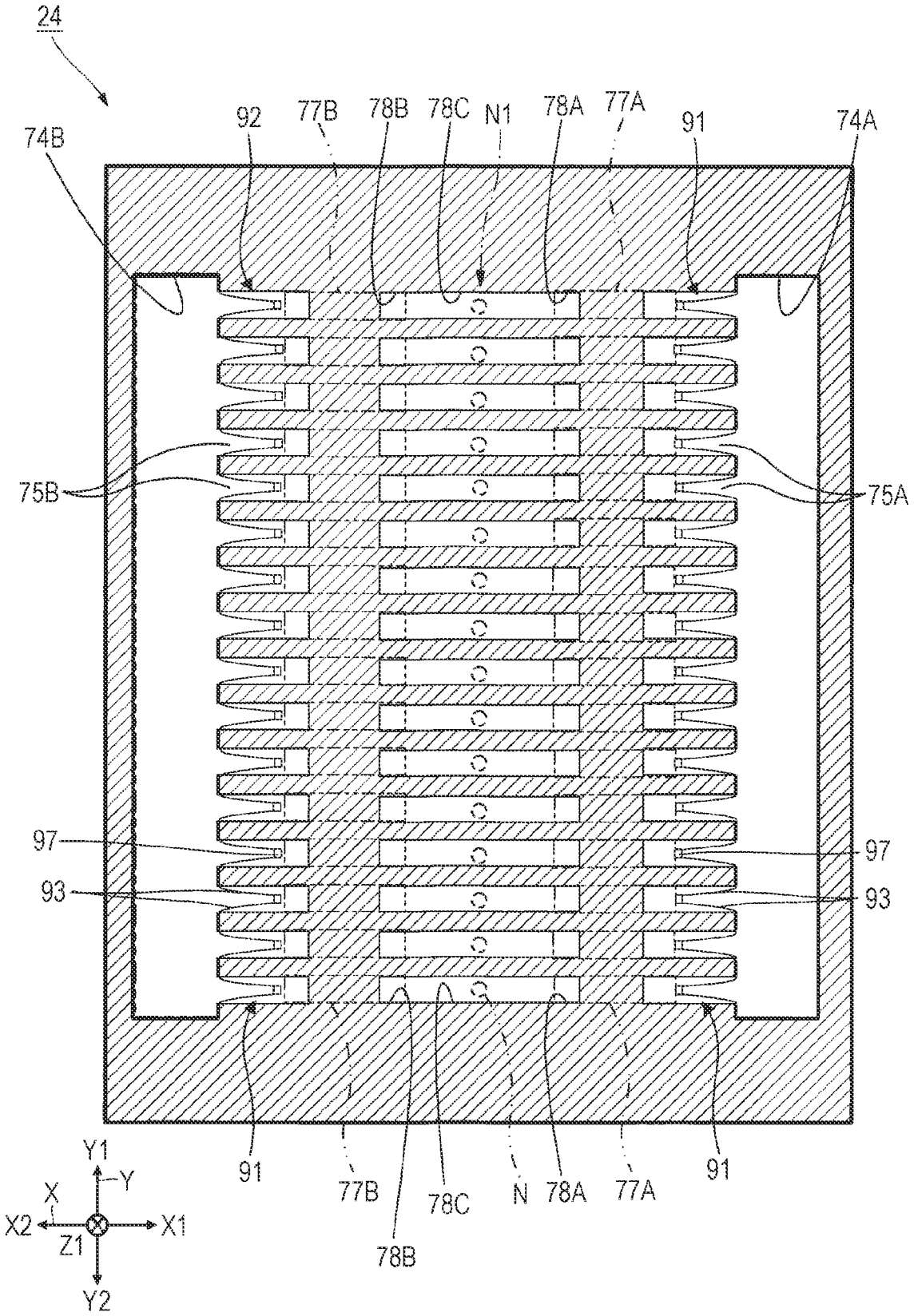
FIG. 19 is a cross-sectional view illustrating the communication plate and is a view illustrating a cross section taken along the line XIX-XIX in FIG. 18.

Next, a liquid discharging head 20B according to a second embodiment will be described with reference to FIGS. 18 and 19. FIG. 18 is a cross-sectional view illustrating the liquid discharging head 20B according to the second embodiment. FIG. 19 is a cross-sectional view illustrating the communication plate and is a view illustrating a cross section taken along the line XIX-XIX in FIG. 18. The difference between the liquid discharging head 20B according to the second embodiment and the liquid discharging head 20 according to the first embodiment is that the relay flow path 75B is provided with the adjustment portion 92. In the description of the second embodiment, the same description as that of the first embodiment will be omitted.

The adjustment portion 92 includes the plurality of leaf springs 93. The adjustment portion 92 has substantially the same configuration as the adjustment portion 91, only the disposition is different. The end portion 94 of the leaf spring 93 is an end portion closer to the common liquid chamber 74B. The end portion 95 of the leaf spring 93 is an end portion farther from the common liquid chamber 74B. A regulation portion 97 is disposed between the end portions 95 of the plurality of leaf springs 93.

For example, when the liquid inside the common liquid chamber 74B is pressurized so as to have a pressure P1, the cross-sectional area of the flow path between the end portions 95 of the leaf spring 93 becomes a cross-sectional area S1. When the liquid inside the common liquid chamber 74B is pressurized so as to have a pressure P2 higher than the pressure P1, the cross-sectional area of the flow path between the end portions 95 becomes a cross-sectional area S2 larger than the cross-sectional area S1.

For example, when the liquid inside the pressure chamber 77B is pressurized so as to have a pressure P3, the cross-sectional area of the flow path between the end portions 95 of the leaf spring 93 becomes a cross-sectional area S3. The cross-sectional area of the flow path between the end portions 95 when the liquid inside the pressure chamber 77B is pressurized so as to have a pressure P4 higher than the pressure P3 is a cross-sectional area S4. The cross-sectional area S3 and the cross-sectional area S4 may be the same. The term the "same" as used herein includes substantially the same and includes cases where it can be regarded as substantially the same. The cross-sectional area S4 may be larger than the cross-sectional area S3. A difference between the cross-sectional area S2 and the cross-sectional area S1 is larger than a difference between the cross-sectional area S4 and the cross-sectional area S3.

According to the liquid discharging head 20B of the second embodiment, since the adjustment portion 91 is provided in the relay flow path 75A and the adjustment portion 92 is provided in the relay flow path 75B, the cross-sectional area of the flow path can be changed to reduce the clogging caused by the particles. In the liquid discharging head 20B, the flow rate can be changed such that the cross-sectional area of the flow path by the adjustment portion 91 is expanded by pressurizing the liquid from the common liquid chamber 74A, and the cross-sectional area of the flow path by the adjustment portion 92 is expanded by pressurizing the liquid from the common liquid chamber 74B, thereby the clogging caused by the particles can be reduced.

Figure 20:
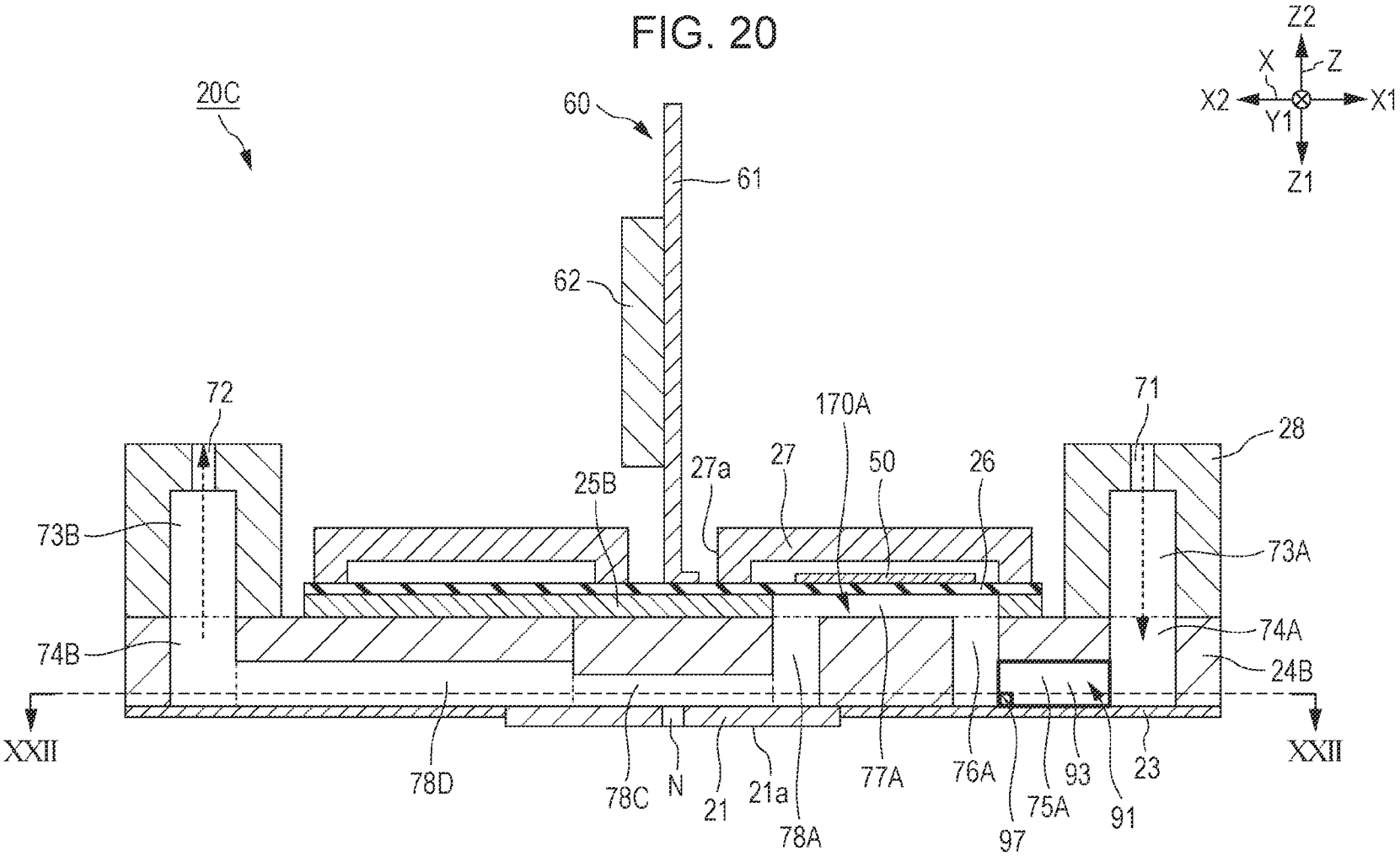
FIG. 20 is a cross-sectional view illustrating a liquid discharging head according to a third embodiment.
Figure 21:
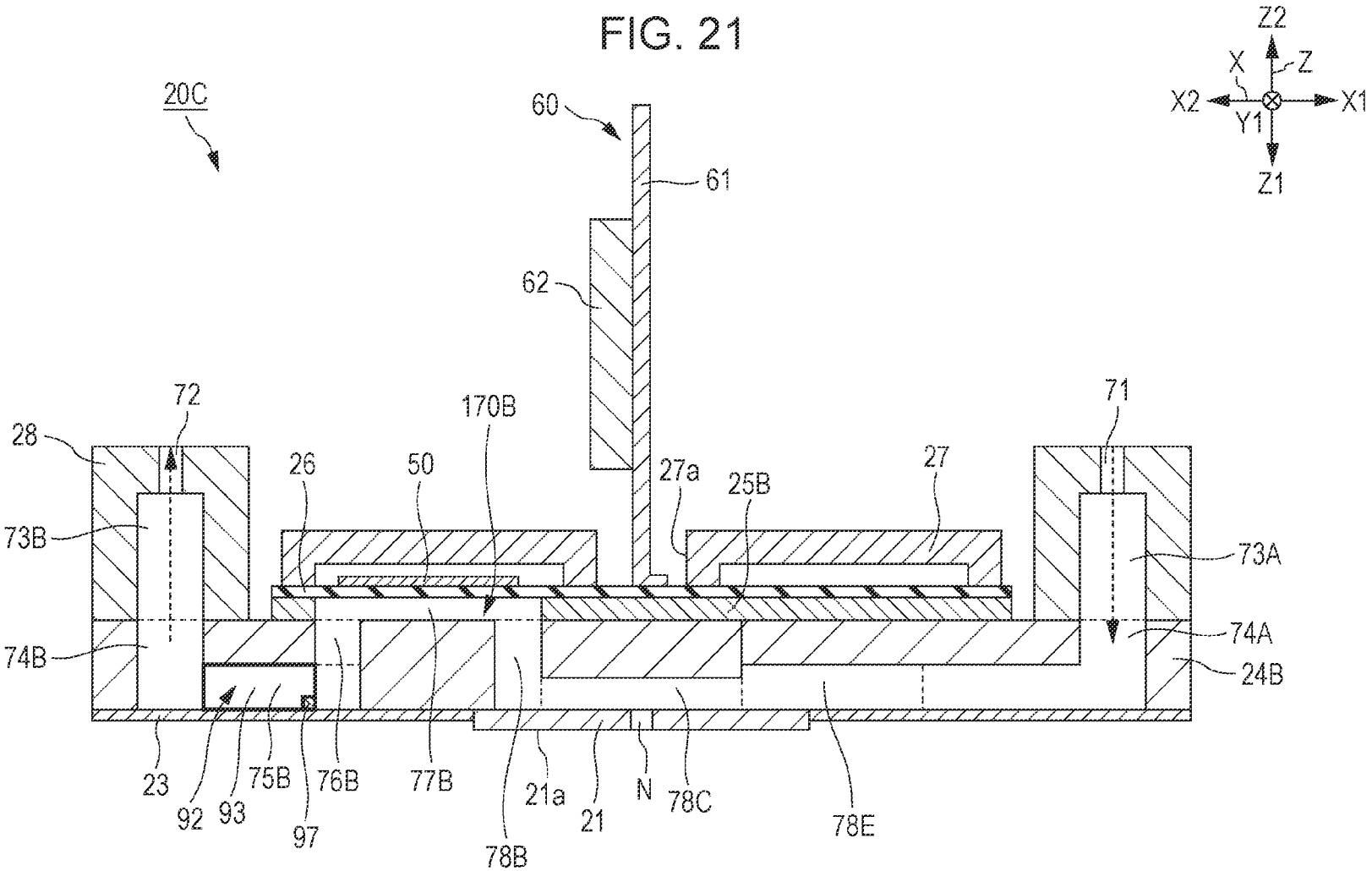
FIG. 21 is a cross-sectional view illustrating the liquid discharging head according to the third embodiment.
Figure 22:
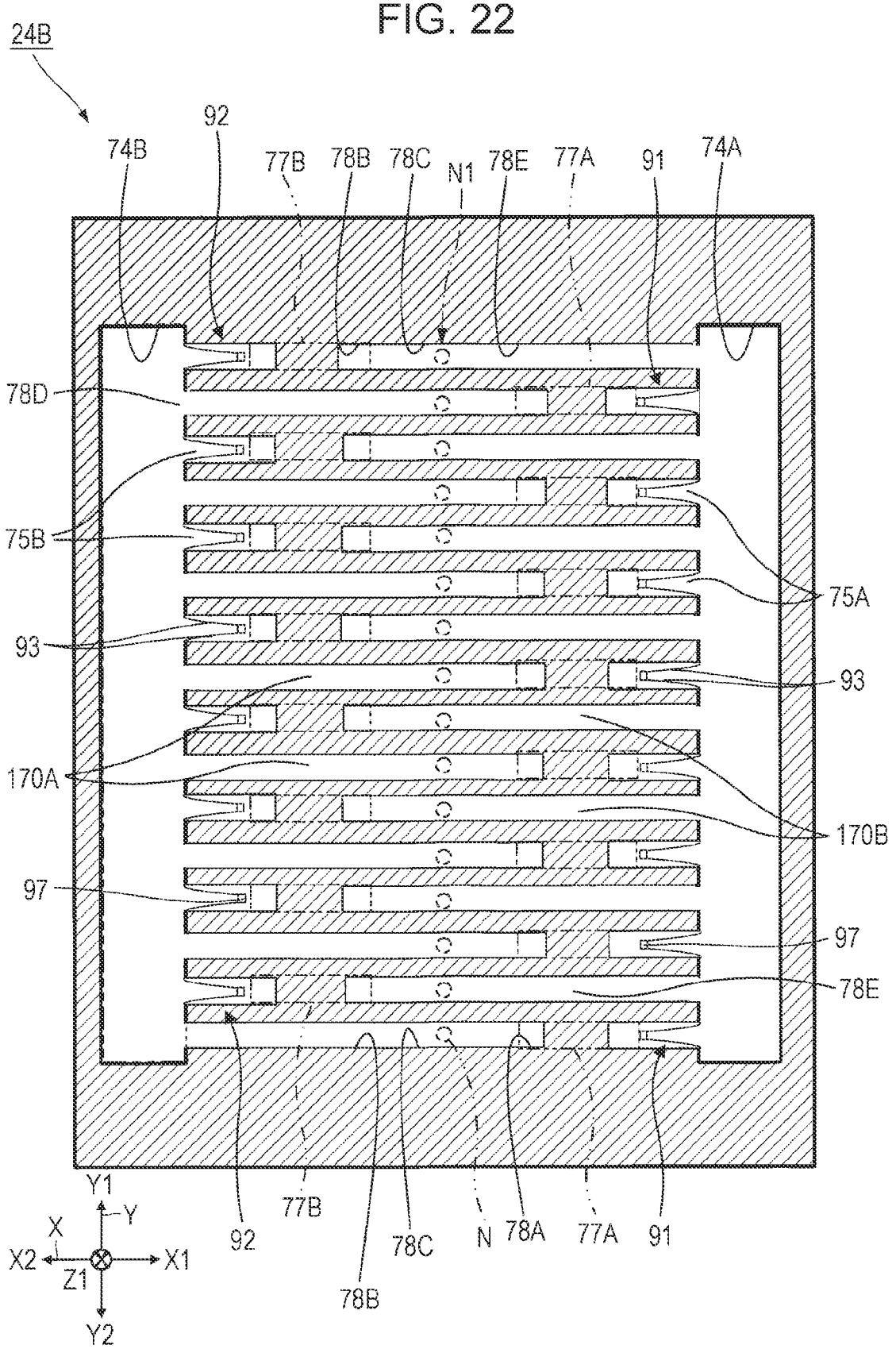
FIG. 22 is a cross-sectional view illustrating the communication plate and is a view illustrating a cross section taken along the line XXII-XXII in FIG. 20.

Next, a liquid discharging head 20C according to a third embodiment will be described with reference to FIGS. 20 to 22. FIGS. 20 and 21 are cross-sectional views illustrating the liquid discharging head 20C according to the third embodiment. FIG. 22 is a cross-sectional view illustrating the communication plate 24B of the liquid discharging head 20C and illustrates a cross section taken along the line XXII-XXII in FIG. 20. The difference between the liquid discharging head 20C of the third embodiment and the liquid discharging head 20 of the first embodiment is that one pressure chamber is provided for one individual flow path. In the description of the second embodiment, the same description as that of the first embodiment will be omitted.

The liquid discharging head 20C includes a communication plate 24B and a pressure chamber formation plate 25B. The liquid discharging head 20C is provided with a plurality of individual flow paths 170A and 170B. FIG. 20 illustrates the individual flow path 170A, and FIG. 21 illustrates the individual flow path 170B. The individual flow paths 170A and 170B are disposed alternately in the Y axis direction. The individual flow path 170A illustrated in FIG. 20 includes the relay flow paths 75A and 76A, the pressure chamber 77A, and the communication flow paths 78A, 78C, and 78D. The communication flow path 78D extends in the X axis direction and makes the communication flow path 78C and the common liquid chamber 74B communicate with each other. The individual flow path 170B illustrated in FIG. 21 includes the relay flow paths 75B and 76B, the pressure chamber 77B, and the communication flow paths 78B, 78C, and 78E. The communication flow path 78E extends in the X axis direction and makes the common liquid chamber 74A and the communication flow path 78C communicate with each other. The common liquid chambers 74A and 74B, the relay flow paths 75A and 75B, and the communication flow paths 78A to 78E are formed in the communication plate 24B. The pressure chambers 77A and 77B are formed in the pressure chamber formation plate 25B. The relay flow path 75A is provided with the adjustment portion 91, and the relay flow path 75B is provided with the adjustment portion 92. The adjustment portions 91 and 92 have the same configuration as described above, and the description thereof will be omitted here. In the liquid discharging head 20C, the common liquid chambers 73A and 74A are examples of a first common supply flow path. The common liquid chambers 73B and 74B are examples of a second common supply flow path. The adjustment portion 91 is an example of a first adjustment portion, and the adjustment portion 92 is an example of a second adjustment portion.

The liquid discharging head 20C of the third embodiment also has the same effect as the liquid discharging heads 20 and 20B of the above embodiment.

Figure 23:
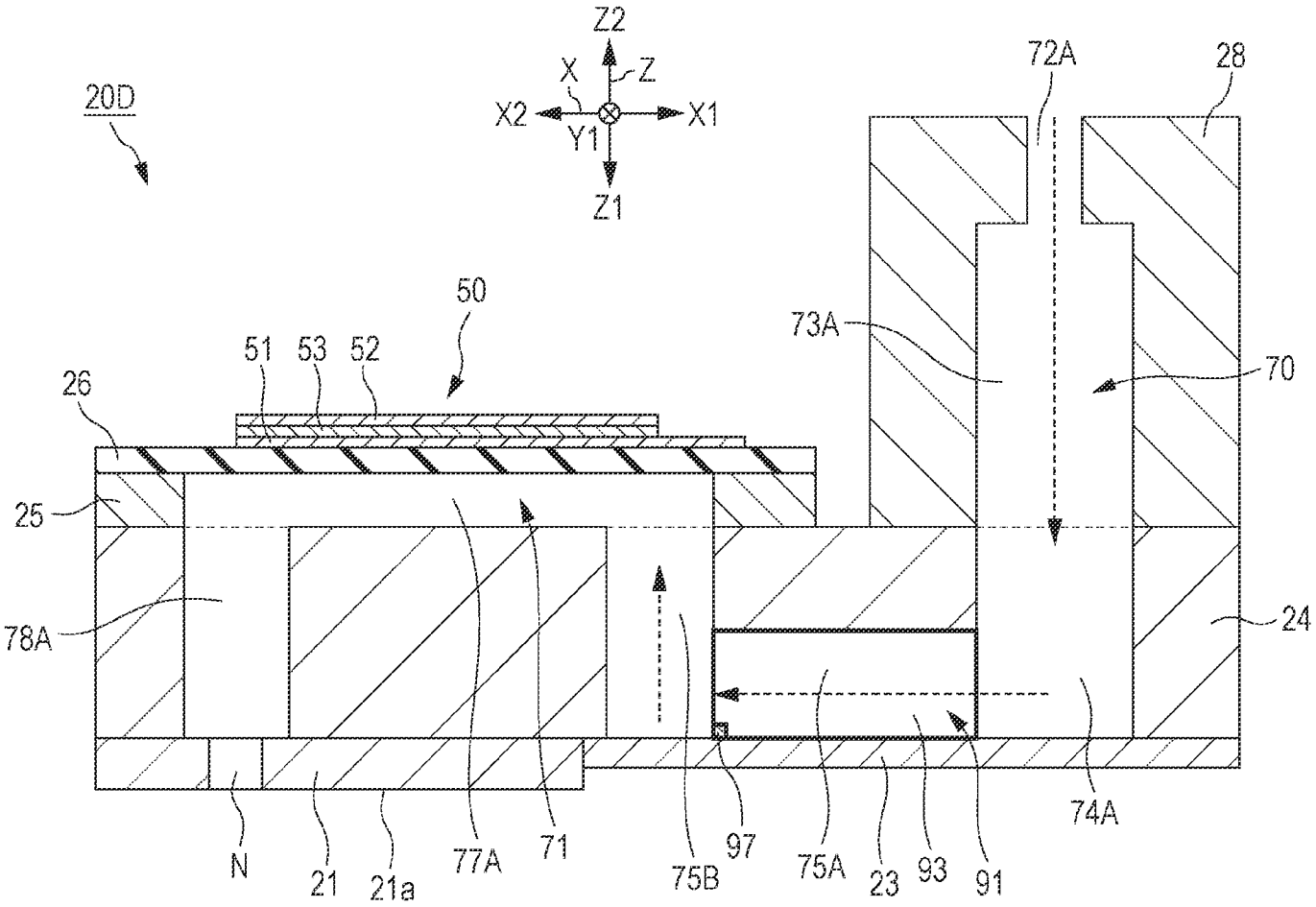
FIG. 23 is a cross-sectional view illustrating a liquid discharging head according to a fourth embodiment.

Next, the liquid discharging head 20D according to a fourth embodiment will be described with reference to FIG. 23. FIG. 23 is a cross-sectional view illustrating the liquid discharging head 20D according to the fourth embodiment. The liquid discharging head 20D according to the fourth embodiment is different from the liquid discharging head 20 according to the first embodiment in that it does not have a flow path on the exhaust side. In the description of the fourth embodiment, the same description as that of the first embodiment may be omitted.

The flow path 70 of the liquid in the liquid discharging head 20D includes the supply port 72A, the common liquid chambers 73A and 74A, the relay flow paths 75A and 76A, the pressure chamber 77A, the communication flow path 78A, and the nozzle N. The communication flow path 78A makes the pressure chamber 77A and the nozzle N communicate with each other. The flow path 70 includes the individual flow path 71. The individual flow path 71 includes the relay flow path 75A, the pressure chamber 77A, the communication flow path 78A, and the nozzle N.

The relay flow path 75A is provided with an adjustment portion 91. The adjustment portion 91 has a plurality of leaf springs 93. In the liquid discharging head 20D according to the fourth embodiment, when the pressurization from the common liquid chamber 74A is performed, the cross-sectional area of the flow path can be expanded by displacing the plurality of leaf springs 93. As a result, it is possible to reduce the clogging of the flow path caused by the particles. In the liquid discharging head 20D, when the discharging is performed, the piezoelectric actuator 50 causes a pressure fluctuation in the liquid inside the pressure chamber 77A, and the liquid can be discharged from the nozzle N. When the discharging is performed, the pressure of the liquid inside the pressure chamber 77A can be prevented from escaping to the common liquid chamber 74A by keeping the flow path between the plurality of leaf springs 93 narrow without expanding the flow path. As a result, the liquid can be reliably discharged from the nozzle N. The liquid discharging head 20D also has the same effect as the liquid discharging heads 20, 20B, and 20C of the above embodiments.

Figure 24:
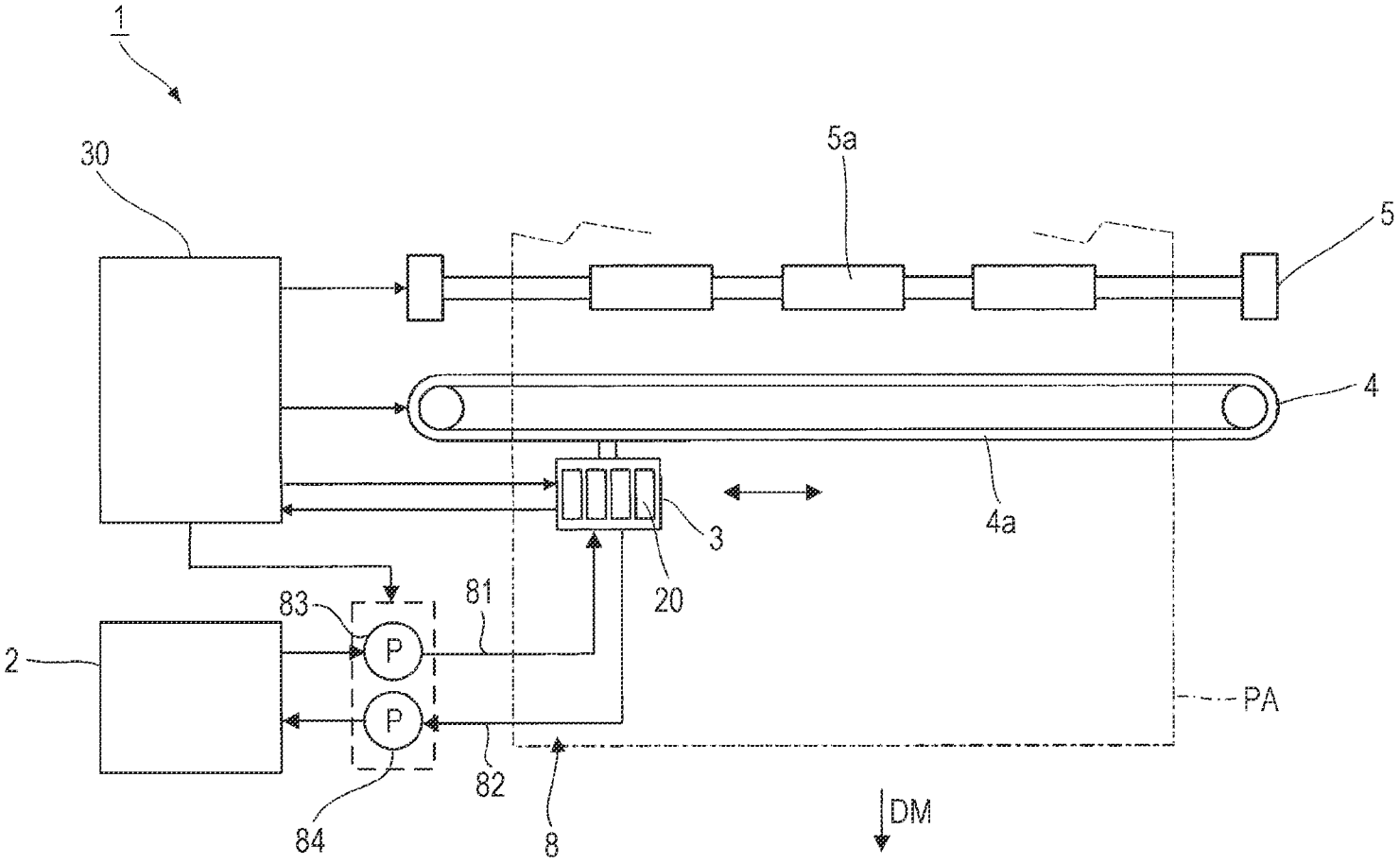
FIG. 24 is a schematic view illustrating a liquid discharging apparatus according to a fifth embodiment.
Figure 25:
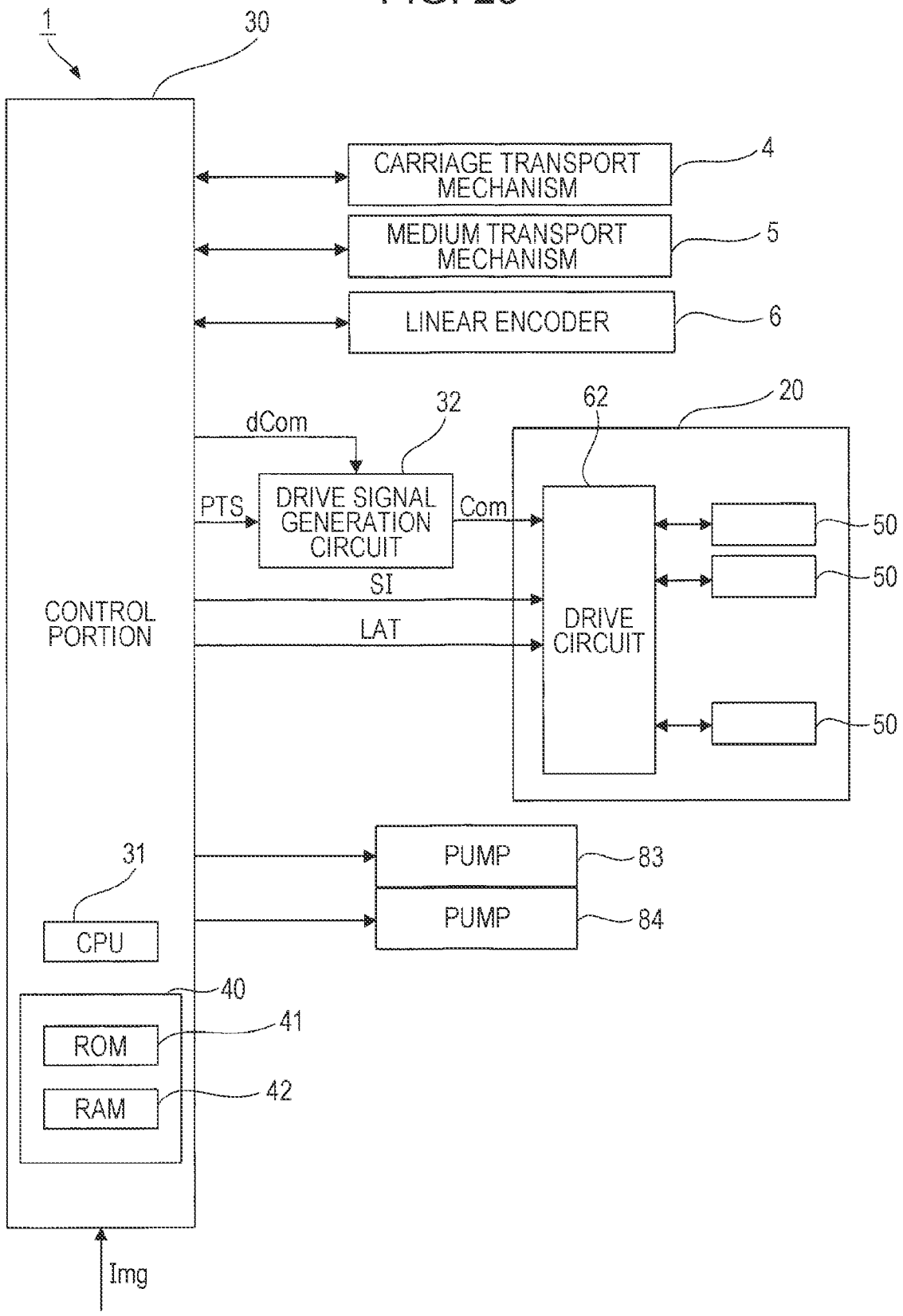
FIG. 25 is a block view illustrating the liquid discharging apparatus.

Next, a liquid discharging apparatus 1 according to a fifth embodiment will be described with reference to FIGS. 24 and 25. The liquid discharging apparatus 1 includes the above-mentioned liquid discharging head 20. In the description of the fifth embodiment, the same description as that of the above-described embodiment will be omitted. FIG. 24 is a schematic view illustrating the liquid discharging apparatus 1 according to the fifth embodiment. FIG. 25 is a block view illustrating the liquid discharging apparatus 1. The liquid discharging apparatus 1 is an ink jet type printing apparatus that discharges the ink, which is an example of "liquid", as droplets onto a medium PA. The liquid discharging apparatus 1 is a serial type printing apparatus. The medium PA is typically printing paper. The medium PA is not limited to printing paper and may be a printing target of any material such as a resin film or cloth.

The liquid discharging apparatus 1 includes a liquid discharging head 20 that discharges ink, a liquid container 2 that stores the ink, a carriage 3 in which the liquid discharging head 20 is mounted, a carriage transport mechanism 4 for transporting the carriage 3, a medium transport mechanism 5 for transporting a medium PA, and a control portion 30. As described above, the liquid discharging apparatus 1 includes a circulation mechanism 8 for circulating the ink. The control portion 30 is an example of a discharge control portion.

As a specific aspect of the liquid container 2, for example, a cartridge that is attachable to and detachable from the liquid discharging apparatus 1, a bag-shaped ink pack made of a flexible film, and an ink tank that can be replenished with the ink are used. Any type of ink can be stored in the liquid container 2. The liquid discharging apparatus 1 includes, for example, a plurality of liquid containers 2 corresponding to four colors of ink. Examples of the four color ink include cyan, magenta, yellow, and black. The liquid container 2 may be mounted on the carriage 3.

The carriage transport mechanism 4 has a transport belt 4*a* and a motor for transporting the carriage 3. The medium transport mechanism 5 has a transporting roller 5*a* and a motor for transporting the medium PA. The carriage transport mechanism 4 and the medium transport mechanism 5 are controlled by the control portion 30. The liquid discharging apparatus 1 transports the carriage 3 by using the carriage transport mechanism 4 while transporting the medium PA by using the medium transport mechanism 5, and then discharges ink droplets to the medium PA for printing.

The liquid discharging apparatus 1 includes a linear encoder 6 as illustrated in FIG. 25. The linear encoder 6 is provided at a position where a position of the carriage 3 can be detected. The linear encoder 6 acquires information related to the position of the carriage 3. The linear encoder 6 outputs an encoder signal to the control portion 30 according to a movement of the carriage 3.

The control portion 30 illustrated in FIG. 2 includes one or more CPUs 31. The control portion 30 may include an FPGA instead of the CPU 31 or in addition to the CPU 31. The control portion 30 includes a storage portion 40. The storage portion 40 includes, for example, a ROM 41 and a RAM 42. The storage portion 40 may include an EEPROM or a PROM. The storage portion 40 can store print data Img supplied from a host computer. The storage portion 40 stores a control program of the liquid discharging apparatus 1.

CPU is an abbreviation for Central Processing Unit. FPGA is an abbreviation for Field-Programmable Gate Array. RAM is an abbreviation for Random Access Memory. ROM is an abbreviation for Read Only Memory. EEPROM is an abbreviation for Electrically Erasable Programmable Read-Only Memory. PROM is an abbreviation for Programmable ROM.

The control portion 30 generates a signal for controlling the operation of each portion of the liquid discharging apparatus 1. The control portion 30 can generate a print signal SI and a waveform designation signal dCom. The print signal SI is a digital signal for designating the type of operation of the liquid discharging head 20. The print signal SI can designate whether or not to supply the drive signal Com to the piezoelectric actuator 50. The waveform designation signal dCom is a digital signal that defines a waveform of the drive signal Com. The drive signal Com is an analog signal for driving the piezoelectric actuator 50.

As described above, the liquid discharging apparatus 1 includes the drive signal generation circuit 32. The drive signal generation circuit 32 is electrically coupled to the control portion 30. The drive signal generation circuit 32 includes a DA conversion circuit. The drive signal generation circuit 32 generates a drive signal Com having a waveform defined by the waveform designation signal dCom. When the control portion 30 receives an encoder signal from a linear encoder 6, the control portion 30 outputs a timing signal PTS to the drive signal generation circuit 32. The timing signal PTS defines a generation timing of the drive signal Com. The drive signal generation circuit 32 outputs the drive signal Com each time the timing signal PTS is received.

The drive circuit 62 is electrically coupled to the control portion 30 and the drive signal generation circuit 32. The drive circuit 62 switches whether or not to supply the drive signal Com to the piezoelectric actuator 50 based on the print signal SI. The drive circuit 62 can select the piezoelectric actuator 50 to which the drive signal Com is supplied based on the print signal SI, the latch signal LAT, and the change signal CH supplied from the control portion 30. The latch signal LAT defines a latch timing of the print data Img. The change signal CH defines a selection timing of the drive pulse included in the drive signal Com.

The control portion 30 controls a discharging operation of the ink by the liquid discharging head 20. As described above, the control portion 30 drives the piezoelectric actuator 50 to cause the pressure of the ink inside the pressure chambers 77A and 77B to fluctuate and discharge the ink from the nozzle N. The control portion 30 controls the discharging operation when the printing operation is performed. The control portion 30 may control the discharging operation when a maintenance operation is performed. As the maintenance operation, the control portion 30 can discharge the ink from the nozzle N before the printing or after the printing so as to reduce thickening of the ink inside the liquid discharging head 20.

The control portion 30 controls the operation of circulating the ink when the maintenance is performed. For example, the control portion 30 can pressurize the ink from the common liquid chambers 73A and 74A by driving the pump 83 in the state in which the nozzle N is sealed to supply the ink into the liquid discharging head 20 from the supply port 72A. In this way, the control portion 30 can change the cross-sectional area of the flow path by the adjustment portion 91 by pressurizing the ink inside the relay flow path 75A from the common liquid chamber 74A to displace the plurality of leaf springs 93. Further, the control portion 30 may control the operation of circulating the ink by driving the pump 84 to supply the ink from the exhaust port 72B into the liquid discharging head 20.

Since such a liquid discharging apparatus 1 includes the liquid discharging head 20, it is possible to reduce the clogging caused by the particles by changing the cross-sectional area of the flow path by the adjustment portion 91. The liquid discharging apparatus 1 may be configured to include the liquid discharging heads 20B, 20C, and 20D instead of the liquid discharging head 20.

The above-described embodiments merely illustrate a typical embodiment of the present disclosure, and the present disclosure is not limited to the above-described embodiments, and various changes and additions can be made without departing from the gist of the present disclosure.

In the above-described embodiments, although the serial type liquid discharging apparatus 1 in which the carriage 3 on which the liquid discharging head 20 is mounted is reciprocated in the width direction of the medium PA is illustrated, the present disclosure may be applied to a line type liquid discharging apparatus including a line head in which the liquid discharging heads 20 are arranged in a predetermined direction.

In the liquid discharging apparatus 1 described above, although the pressurization operation of pressurizing the liquid from the pressure chamber 77A toward the common liquid chamber 74A is performed by using the pump 84 in the state in which the plurality of nozzles N are sealed, the method for pressurizing the liquid in the pressurization operation is not limited to the pump. For example, other pressurizing methods may be used to perform the pressurization operation. Further, the pressurization operation by the pump 84 and the pressurization operation by the piezoelectric actuator 50 may be alternately performed with respect to the liquid discharging head 20. Further, the pressurization operation by the pump 84 and the pressurization operation by the piezoelectric actuator 50 may be performed with respect to the liquid discharging head 20 at the same time.

The liquid discharging apparatus 1 exemplified in the above-described embodiment can be adopted not only in an apparatus dedicated to printing but also in various apparatus such as a facsimile apparatus and a copying machine. Moreover, the application of the liquid discharging apparatus of the present disclosure is not limited to printing. For example, a liquid discharging apparatus that discharges a solution of a coloring material is utilized as a manufacturing apparatus that forms a color filter of a display apparatus such as a liquid crystal display panel. Further, a liquid discharging apparatus that discharges a solution of a conductive material is utilized as a manufacturing apparatus that forms wiring or electrodes of a wiring substrate. Further, a liquid discharging apparatus that discharges a solution of an organic substance related to a living body is utilized, for example, as a manufacturing apparatus that manufactures a biochip.

In the above description, the average particle diameter of the particles included in the liquid is exemplified as 2 μm or more, but the average particle diameter of the particles included in the liquid is not limited to this. For example, when the environmental resistance is taken into consideration, it is better that the average particle diameter is large. The environmental resistance includes light resistance and water resistance. For example, when graininess is taken into consideration, it is better that the average particle diameter is small.

For example, when the bio-related liquid is applied to the liquid discharging apparatus, the liquid may include particles such as artificial red blood cells. The diameter of erythrocytes is, for example, substantially 7 to 8 μm, and the thickness of the erythrocytes is substantially 2 μm. The liquid discharging apparatus 1 may be used, for example, in the manufacturing process of the artificial red blood cells. For example, the use of the liquid discharging apparatus 1 is expected for the manufacturing of the artificial blood with higher accuracy than that of in the related art.

Examples of the particles included in the liquid applied to the liquid discharging apparatus 1 include a metallic tone pigment. For example, in order to develop a silver color, it is necessary to reflect all wavelengths in the visible light region, which requires a plane having a size sufficiently larger than the wavelength. Since the size of the visible light is substantially 0.4 to 0.7 μm, it is desired that the average particle diameter is 2 μm or more, which is sufficiently larger than the size of the visible light. The liquid discharging apparatus 1 may discharge the liquid including a metallic tone pigment having an average particle diameter of 2 μm or more.

Examples of the particles included in the liquid applied to the liquid discharging apparatus 1 include a pearl tone pigment. The pearl tone pigment is the same as the metallic tone, but since the pearl tone is reproduced by reflecting leaf-shaped mica in multiple layers at a plurality of intervals, a size that is one size larger than the metallic tone pigment is desired. The liquid discharging apparatus 1 may discharge the liquid including a pearl tone pigment having an average particle diameter of 2 μm or more.

The liquid discharging apparatus 1 may be applied to metal wiring or die bonding. Silver particle paste is used for bonding the metal wiring or IC chips. In recent years, there have been an increasing number of cases where silver particles with a level of several nm are used but there are concerns about the increase in environmental load and the impact on the human body in the manufacturing process of nano-silver particles. For example, in a case where the particle concentration is increased, since there is a correlation between particle size and viscosity, it has been reported that the viscosity of the liquid tends to increase remarkably particularly when the particle size is 1 μm or less. Thereby, in order to make the high-concentration dispersion liquid have a viscosity that can be discharged from the liquid discharging apparatus 1, it is desirable that the average particle diameter is 2 μm or more.

The liquid discharging apparatus 1 may be used, for example, in the technical field of a liquid crystal display or an adhesive gap agent. In order to secure the cell gap of the liquid crystal display or the adhesive intensity, it is desirable to precisely apply an adhesive agent in which particles of, for example, substantially 2 to 10 μm are kneaded.

What is claimed is:

1. A liquid discharging head that discharges liquid from a nozzle, comprising:

a plurality of individual flow paths including a pressure chamber that communicates with the nozzle;

a common supply flow path communicating in common with the plurality of individual flow paths and supplying the liquid to the plurality of individual flow paths; and an adjustment portion provided between the pressure chamber and the common supply flow path and changing a cross-sectional area of a flow path through which the liquid flows, wherein when a pressure of the liquid inside the common supply flow path is higher than a pressure of the liquid inside the pressure chamber, the adjustment portion changes the cross-sectional area to be a first cross-sectional area when a pressure difference, which is a difference between the pressure of the liquid inside the common supply flow path and the pressure of the liquid inside the pressure chamber, is a first pressure difference, and changes the cross-sectional area to be a second cross-sectional area larger than the first cross-sectional area when the pressure difference is a second pressure difference larger than the first pressure difference.

2. The liquid discharging head according to claim 1, wherein when the pressure of the liquid inside the pressure chamber is higher than the pressure of the liquid inside the common supply flow path, the adjustment portion changes the cross-sectional area to be a third cross-sectional area when the pressure difference is a third pressure difference, and changes the cross-sectional area to be a fourth cross-sectional area when the pressure difference is a fourth pressure difference larger than the third pressure difference, and a difference between the third cross-sectional area and the fourth cross-sectional area is smaller than a difference between the first cross-sectional area and the second cross-sectional area.

3. The liquid discharging head according to claim 2, wherein the third cross-sectional area is equal to the fourth cross-sectional area.

4. The liquid discharging head according to claim 2, wherein a difference between the third pressure difference and the fourth pressure difference is equal to a difference between the first pressure difference and the second pressure difference.

5. The liquid discharging head according to claim 1, wherein the adjustment portion has a leaf spring, an end portion of the leaf spring closer to the common supply flow path is a fixed end, and an end portion of the leaf spring closer to the pressure chamber is a free end.

6. The liquid discharging head according to claim 1, wherein the adjustment portion has a leaf spring, an end portion of the leaf spring closer to the common supply flow path is a fixed end, and an end portion of the leaf spring closer to the pressure chamber is a fixed end.

7. The liquid discharging head according to claim 5, further comprising:

a flow path substrate on which at least a part of the common supply flow path is formed, wherein the fixed end, which is the end portion of the leaf spring closer to the common supply flow path, is fixed to the flow path substrate.

8. The liquid discharging head according to claim 5, further comprising:

a plurality of the leaf springs with respect to one individual flow path, wherein the plurality of the leaf springs are separated from each other in a second direction orthogonal to a first direction along the individual flow path.

9. The liquid discharging head according to claim 5, further comprising:

a regulation portion that regulates a displacement of the leaf spring in a plate thickness direction.

10. The liquid discharging head according to claim 5, further comprising:

an elastically deformable filler disposed in a gap between a wall surface of the individual flow path, which is present in a direction in which the leaf spring moves when the cross-sectional area of the flow path is expanded, and the leaf spring.

11. The liquid discharging head according to claim 1, further comprising:

a common exhaust flow path communicating in common with the plurality of individual flow paths and exhausting the liquid from the plurality of individual flow paths, wherein the adjustment portion that changes the cross-sectional area of the flow path is not provided between the pressure chamber and the common exhaust flow path.

12. The liquid discharging head according to claim 1, further comprising:

a first common supply flow path that is the common supply flow path;

a first adjustment portion that is the adjustment portion;

a second common supply flow path communicating in common with the plurality of individual flow paths, supplying the liquid to the plurality of individual flow paths, and different from the first common supply flow path; and a second adjustment portion provided between the pressure chamber and the second common supply flow path and changing the cross-sectional area of the flow path through which the liquid flows.

13. The liquid discharging head according to claim 1, wherein an average particle diameter of a coloring material included in the liquid is 2 μm or more.

14. A liquid discharging apparatus comprising:

the liquid discharging head according to claim 1; and a discharge control portion controlling a discharging operation of discharging the liquid from the liquid discharging head.

* * * * *